US012460522B2

(12) United States Patent
Campbell et al.

(10) Patent No.: US 12,460,522 B2
(45) Date of Patent: Nov. 4, 2025

(54) COLLET BAFFLE, A TOOL INCORPORATING SAME, AND A SYSTEM AND METHOD INCORPORATING SAME, FOR PERFORATING AND FRACKING A WELLBORE NOT HAVING INITIAL PORTS OR SLIDING SLEEVES

(71) Applicants: Sean P. Campbell, Airdrie (CA); Daniel Rojas, Cyperss, TX (US); David Speller, Houston, TX (US)

(72) Inventors: Sean P. Campbell, Airdrie (CA); Daniel Rojas, Cyperss, TX (US); David Speller, Houston, TX (US)

(73) Assignee: SC Asset Corporation, Calgary (CA)

( * ) Notice: Subject to any disclaimer, the term of this patent is extended or adjusted under 35 U.S.C. 154(b) by 0 days.

(21) Appl. No.: 17/746,273

(22) Filed: May 17, 2022

(65) Prior Publication Data

US 2023/0374893 A1 Nov. 23, 2023

(51) Int. Cl.
*E21B 43/16* (2006.01)
*E21B 29/02* (2006.01)
(Continued)

(52) U.S. Cl.
CPC ..... *E21B 43/16* (2013.01); *E21B 29/02* (2013.01); *E21B 33/1208* (2013.01);
(Continued)

(58) Field of Classification Search
CPC ..... E21B 43/26; E21B 33/12; E21B 43/16; E21B 29/02
See application file for complete search history.

(56) References Cited

U.S. PATENT DOCUMENTS 2,749,840 A 6/1956 Babcock
2,862,564 A 12/1958 Bostock
(Continued)

FOREIGN PATENT DOCUMENTS

CA 2412072 A1 5/2003
CA 2797821 C 11/2011
(Continued)

OTHER PUBLICATIONS

International Search Report issued in PCT/CA2022/050775, mailed Jan. 16, 2023, pp. 1-3.
(Continued)

*Primary Examiner* — Nicole Coy
*Assistant Examiner* — Jennifer A Railey
(74) *Attorney, Agent, or Firm* — Gowling WLG (Canada)

(57) ABSTRACT

A specialized wireline-conveyed collet baffle, adapted for use with a conveying tool, setting tool, and explosive charges, for perforating and fracking a wellbore. The collet baffle like prior art baffles possesses an annular ring for engaging a circumferential annular groove in a casing, but unlike prior art baffles possesses an inner annular hollow ring member which may be actuated by a push rod of a setting tool and slidably repositioned when such annular ring underlies and is engaged with the circumferential groove on a casing sub, thereby retaining the collet baffle in place in the casing string when the conveying tool, setting tool, and explosive charges are subsequently re-positioned uphole. An adapter tool for coupling the collet baffle to a conventional setting tool, a wireline system employing the specialized collet baffle and adapter tool, and a method for perforating and fracking a wellbore are further disclosed.

16 Claims, 13 Drawing Sheets

(51) Int. Cl.
*E21B 33/12* (2006.01)
*E21B 23/02* (2006.01)

(52) U.S. Cl.
CPC ..... *E21B 23/02* (2013.01); *E21B 33/12* (2013.01); *E21B 2200/08* (2020.05)

(56) References Cited

U.S. PATENT DOCUMENTS

| | | | |
|---|---|---|---|
| 3,115,188 | A | 12/1963 | Brown |
| 3,263,752 | A | 8/1966 | Conrad |
| 3,656,562 | A | 4/1972 | Baugh |
| 3,856,081 | A | 12/1974 | Canalizo |
| 4,043,392 | A | 8/1977 | Gazda |
| 4,167,970 | A | 9/1979 | Cowan |
| 4,436,152 | A | 3/1984 | Fisher, Jr. et al. |
| 4,723,606 | A | 2/1988 | Vinzant et al. |
| 4,817,718 | A | 4/1989 | Nelson |
| 4,893,678 | A | 1/1990 | Stokley et al. |
| 4,896,721 | A | 1/1990 | Welch |
| 5,305,833 | A | 4/1994 | Collins |
| 5,309,988 | A | 5/1994 | Shy et al. |
| 5,449,039 | A | 9/1995 | Hartley et al. |
| 5,513,703 | A | 5/1996 | Mills |
| 5,579,829 | A | 12/1996 | Comeau |
| 5,641,023 | A | 6/1997 | Ross et al. |
| 5,730,224 | A | 3/1998 | Williamson et al. |
| 6,095,541 | A | 8/2000 | Turner et al. |
| 6,199,632 | B1 | 3/2001 | Shy |
| 6,202,746 | B1 | 3/2001 | Vandenberg |
| 6,631,768 | B2 | 10/2003 | Patel |
| 6,907,936 | B2 | 6/2005 | Fehr et al. |
| 7,325,617 | B2 | 2/2008 | Murray |
| 7,395,856 | B2 | 7/2008 | Murray |
| 7,441,601 | B2 | 10/2008 | George et al. |
| 7,552,779 | B2 | 6/2009 | Murray |
| 7,909,108 | B2 | 3/2011 | Swor |
| 7,926,580 | B1 | 4/2011 | Darnell |
| 8,215,411 | B2 | 7/2012 | Flores et al. |
| 8,365,824 | B2 | 2/2013 | Phillips |
| 8,393,402 | B2 | 3/2013 | Saurer |
| 8,395,879 | B1 | 3/2013 | Gorst et al. |
| 8,678,097 | B1 | 3/2014 | Telfer |
| 8,813,848 | B2 | 8/2014 | Frazier |
| 8,869,903 | B2 | 10/2014 | Thomas et al. |
| 9,127,520 | B2 | 9/2015 | Steele |
| 9,534,471 | B2 | 1/2017 | Etzel |
| 9,574,439 | B2 | 2/2017 | Joseph |
| 9,587,464 | B2 | 3/2017 | Jani |
| 9,611,727 | B2 | 4/2017 | Campbell et al. |
| 9,644,454 | B2 | 5/2017 | Jani |
| 9,739,117 | B2 | 8/2017 | Campbell |
| 9,840,890 | B2 | 12/2017 | Nordheimer |
| 9,840,892 | B2 | 12/2017 | Nordheimer |
| 9,938,788 | B2 | 4/2018 | Barbato |
| 9,976,394 | B1 | 5/2018 | Campbell |
| 10,001,001 | B2 | 6/2018 | Jani |
| 10,519,748 | B2 | 12/2019 | Campbell |
| 10,538,993 | B2 | 1/2020 | Jani |
| 10,563,482 | B2 | 2/2020 | Campbell |
| 10,563,487 | B2 | 2/2020 | Campbell |
| 10,577,890 | B2 | 3/2020 | Nordheimer |
| 10,584,559 | B2 | 3/2020 | Campbell |
| 10,587,890 | B2 | 3/2020 | Camas |
| 10,605,050 | B2 | 3/2020 | Campbell |
| 10,954,747 | B2 | 3/2021 | Campbell |
| 11,091,986 | B2 | 8/2021 | Campbell |
| 11,248,445 | B2 | 2/2022 | Campbell |
| 11,255,158 | B2 | 2/2022 | Campbell |
| 2002/0166667 | A1 | 11/2002 | Patel |
| 2003/0173089 | A1 | 9/2003 | Westgard |
| 2004/0118564 | A1 | 6/2004 | Themig |
| 2004/0149452 | A1 | 8/2004 | Pendleton |
| 2005/0011650 | A1 | 1/2005 | Harrall et al. |
| 2006/0124310 | A1 | 6/2006 | Lopez de Cardenas |
| 2007/0221373 | A1 | 9/2007 | Murray |
| 2007/0221384 | A1 | 9/2007 | Murray |
| 2007/0261862 | A1 | 11/2007 | Murray |
| 2010/0212911 | A1 | 8/2010 | Chen |
| 2010/0221291 | A1 | 9/2010 | Gagnieu |
| 2011/0240301 | A1 | 10/2011 | Robinson et al. |
| 2011/0284243 | A1 | 11/2011 | Frazier |
| 2012/0152550 | A1 | 6/2012 | East |
| 2013/0037255 | A1 | 2/2013 | Kash et al. |
| 2013/0056220 | A1 | 3/2013 | Sommers et al. |
| 2013/0062063 | A1* | 3/2013 | Baihly ..... E21B 43/114 166/376 |
| 2013/0068484 | A1 | 3/2013 | Themig |
| 2013/0081827 | A1 | 4/2013 | Etzel |
| 2013/0112436 | A1 | 5/2013 | Fleming |
| 2013/0168098 | A1 | 7/2013 | Campbell |
| 2013/0180715 | A1 | 7/2013 | Harris |
| 2013/0206402 | A1 | 8/2013 | Coon |
| 2013/0299200 | A1 | 11/2013 | Hughes |
| 2013/0312965 | A1 | 11/2013 | Themig |
| 2013/0319669 | A1 | 12/2013 | DuPree |
| 2014/0034310 | A1 | 2/2014 | Andersen |
| 2014/0102709 | A1 | 4/2014 | Arabskyy |
| 2014/0124214 | A1 | 5/2014 | Mailand et al. |
| 2014/0196888 | A1 | 7/2014 | Martin |
| 2014/0209306 | A1 | 7/2014 | Hughes et al. |
| 2014/0246207 | A1 | 9/2014 | Hofman et al. |
| 2014/0251612 | A1 | 9/2014 | Powers |
| 2015/0060076 | A1 | 3/2015 | Campbell |
| 2015/0218916 | A1 | 8/2015 | Richards et al. |
| 2015/0226034 | A1 | 8/2015 | Jani |
| 2015/0226035 | A1 | 8/2015 | Jani |
| 2016/0061011 | A1 | 3/2016 | Ireland |
| 2016/0097257 | A1 | 4/2016 | Jani |
| 2016/0108711 | A1 | 4/2016 | Lynk |
| 2016/0160600 | A1 | 6/2016 | Silva |
| 2016/0251923 | A1 | 9/2016 | Keerthivasan |
| 2016/0258251 | A1 | 9/2016 | Hornsby |
| 2016/0265294 | A1 | 9/2016 | Robertson |
| 2016/0312580 | A1 | 10/2016 | Nordheimer |
| 2017/0130553 | A1* | 5/2017 | Harris ..... E21B 33/1291 |
| 2017/0198543 | A1 | 7/2017 | Nordheimer |
| 2017/0314370 | A1 | 11/2017 | Bruce |
| 2017/0350215 | A1 | 12/2017 | Campbell |
| 2018/0003005 | A1 | 1/2018 | Dorban |
| 2018/0258701 | A1 | 9/2018 | Saurer |
| 2018/0274316 | A1 | 9/2018 | Dancer |
| 2020/0182015 | A1 | 6/2020 | Campbell |
| 2020/0182017 | A1 | 6/2020 | Campbell |
| 2020/0182018 | A1 | 6/2020 | Nordheimer |
| 2020/0362661 | A1 | 11/2020 | Nordheimer et al. |

FOREIGN PATENT DOCUMENTS

| | | | |
|---|---|---|---|
| CA | 2850134 | A1 | 4/2013 |
| CA | 2842568 | A1 | 5/2014 |
| CA | 2867207 | C | 12/2014 |
| CA | 2879044 | C | 3/2015 |
| CA | 2904470 | A1 | 11/2015 |
| CA | 2927850 | C | 7/2016 |
| CA | 2948027 | A1 | 5/2017 |
| CA | 2916982 | C | 6/2017 |
| CA | 2966123 | C | 7/2017 |
| CA | 2986352 | C | 11/2018 |
| RU | 2262582 | C1 | 10/2005 |
| RU | 2492318 | C2 | 9/2013 |
| WO | 2007112211 | A1 | 10/2007 |
| WO | 2010096309 | A1 | 8/2010 |
| WO | 2011008592 | A2 | 1/2011 |
| WO | 2011134069 | A1 | 11/2011 |
| WO | 2011146210 | A1 | 11/2011 |
| WO | 2012045165 | A1 | 4/2012 |
| WO | 2013048810 | A1 | 4/2013 |
| WO | 2013070446 | A1 | 5/2013 |
| WO | 2014020335 | A2 | 2/2014 |
| WO | 2014209645 | A1 | 12/2014 |
| WO | 2015160342 | A1 | 10/2015 |
| WO | 2016018429 | A1 | 2/2016 |
| WO | 2016019471 | A1 | 2/2016 |

(56) References Cited

FOREIGN PATENT DOCUMENTS

| | | | |
|---|---|---|---|
| WO | 2016178004 | A1 | 11/2016 |
| WO | 2016178005 | A1 | 11/2016 |
| WO | 2018000075 | A1 | 1/2018 |

OTHER PUBLICATIONS

Written Opinion issued in PCT/CA2022/050775, mailed Jan. 16, 2023, pp. 1-3.

* cited by examiner

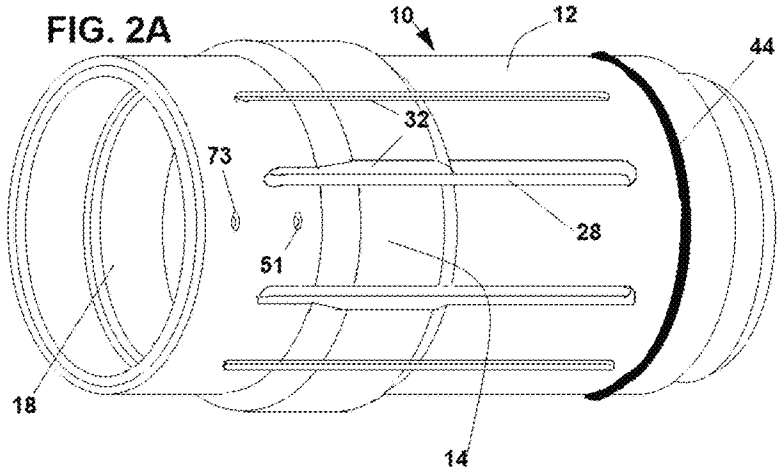
FIG. 2A
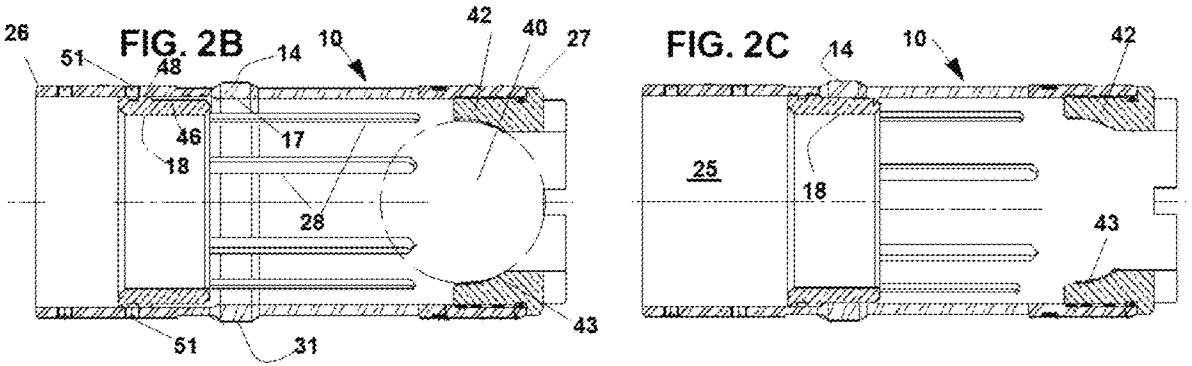
FIG. 2B
FIG. 2C
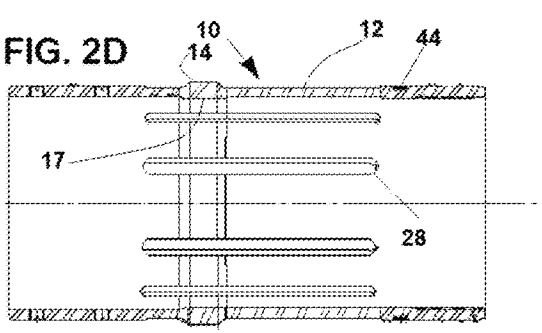
FIG. 2D

COLLET BAFFLE, A TOOL INCORPORATING SAME, AND A SYSTEM AND METHOD INCORPORATING SAME, FOR PERFORATING AND FRACKING A WELLBORE NOT HAVING INITIAL PORTS OR SLIDING SLEEVES

FIELD OF THE INVENTION

The present invention relates to downhole tools for use in completion of drilled hydrocarbon wells and as well to related systems and methods for perforating and fracking wellbore within a hydrocarbon formations so as to thereafter be able to produce hydrocarbons from such wellbore.

BACKGROUND OF THE INVENTION AND DESCRIPTION OF THE PRIOR ART

Because wellbores within a hydrocarbon formation may not be entirely vertical, and in instances in deviated wellbores at some locations along the wellbore may be substantially horizontal, reference herein to "uphole" and "downhole" with regard to a particular component of a system or with respect to a method is a reference to a location on the component when within a wellbore, where uphole means in the direction along the casing towards the surface, or on a surface side of a tool or component when in a wellbore, and "downhole" is a reference to the correspondingly opposite direction towards a toe of the wellbore, or on the "toe" side of a tool or component when situated in a wellbore.

The process of injecting pressurized fluid within a hydrocarbon-containing formation along various points along a wellbore in a hydrocarbon formation to create fissures in the rock within the formation is commonly referred to as "fracking".

It has been known for many years that significant improvement in rates of hydrocarbon recovery can be obtained if a hydrocarbon formation is, prior to production, fracked, namely injected with a high pressure fluid at various points along the wellbore to thereby increase fractures and fissures in the rock surrounding the wellbore to thereby increase the permeability of "tight" formations and thus the flow of hydrocarbons into the wellbore.

It has further been known that adding a proppant to such fracking fluid may assist in maintaining the created fractures in an open condition around the wellbore and further assist in maintaining flow of hydrocarbons though such created fractures into the wellbore for subsequent production to surface.

Fracking operations of the prior art from earliest times have used the so-called "plug and perf" process. In one manifestation of such so-called "plug and perf" process, a wireline having at a distal end thereof an actuatable packer element and immediately uphole therefrom a series of electrically actuated explosive charges, would be lowered a known distance in a wellbore to a desired location along such wellbore that is desired to be fracked. At such location the packer would then be actuated to thereby seal the casing or tubing and prevent high pressure fluid uphole of the packer from flowing further downhole.

Upon actuation of the packer element and sealing of the wellbore, the wireline, setting tool, and explosive charges would be caused to be disengaged from the actuated packer (now in sealing contact with the casing) and the wireline, setting tool, and explosive charges thereon repositioned slightly uphole therefrom to the desired location for fracking. Thereafter a first explosive charge on the wireline would be detonated to create perforations in the casing at such location.

The wireline would be then pulled slightly further uphole to a further location and further explosive charges detonated to perforate the casing at further uphole locations.

Upon completion of such steps the wireline and associated setting tool would be removed from the wellbore. High pressure fluid would then be injected in the wellbore and caused to flow into the hydrocarbon formation at the location of the perforations/apertures created in the casing of the wellbore.

Lowering additional successive wirelines, each with a packer and explosive charges at a distal end thereof, would be repeated at successively more uphole locations along the wellbore, until a satisfactory number of perforations had been created in the casing at specific desired locations along the wellbore, with the formation being successively "fracked" at each of such desired locations.

Upon completion of the above process with the wellbore as a result being fracked along its length, each of the actuated packer elements within the casing string would be removed from the wellbore via a milling operation, wherein a milling tool would be lowered in the wellbore which would mill out each actuated packer element, thereby then opening the wellbore for fluid flow therein and allowing hydrocarbons to flowing into the wellbore via the created formation, and to thereafter flow in the casing string to allow them to be flowed or pumped to surface.

In an alternative to the "plug and pelf" method, to avoid having to "trip out" wirelines after each perforation and fracking operation at each desired location along the wellbore, casing strings having pre-provided ports therein spaced at desired intervals in the casing string were instead utilized. These pre-provided ports were initially each covered with respective hollow sliding sleeves, with sliding sleeves having a smaller bore being more downhole than sleeves of larger diameter bore. By flowing balls of ever-increasing diameter downhole, each of which becomes lodged in a bore of a desired sliding sleeve and upon subsequent injection of a pressured fluid in the wellbore an individual sliding sleeve could thus be forced to slidably move downhole and uncover and thereby open the associated port. The wellbore could then be fracked at such location.

By then successively dropping balls of ever-increasing diameter, a wellbore could be progressively fracked along its length.

The aforesaid process of fracking became known as the "graduated ball drop" method.

After fracking was carried out using the above graduated ball drop method and immediately prior to production commencing, the dropped balls which had been flowed into the wellbore could be each milled out from the wellbore by insertion of a milling tool within the wellbore and the wellbore thereafter thus opened for production. Notably, the needed milling operation could be avoided, if desired, by providing each ball be dissolvable when exposed to a fluid, preferably but not necessarily a corrosive fluid. For example, in a case where the dropped balls are constructed of magnesium, pump down of a water-containing liquid or corrosive fluid, or simply employing a corrosive fracking fluid, after a relatively short period of time, would cause the ball to dissolve and thereby remove the balls from the wellbore and open it for production and further save having to mill out the balls from within the casing string.

Subsequent modifications were later made to both the aforesaid "plug and perf" and "graduated ball drop" prior art methods and systems, such as set out and described in U.S. Pat. Nos. 10,001,001 and 10,538,993, 9,587,464, and 9,840,892 each of which is commonly assigned to the Applicant herein (hereinafter "modified prior art methods and systems").

In at least one embodiment of each of the aforesaid patents, such prior art patents each disclosed a method which provided a series of pre-provided spaced ports in the casing string, each port having an associated sliding sleeve, with each sliding sleeve having a groove therein of a unique width. Sliding sleeves with the widest groove were situated the farthest downhole, with sleeves of progressively lesser groove width being successively located for each subsequent uphole port. Darts or "pump-down members" with or without a ball plug initially therein and each having a radially outwardly-biased protuberance thereon of a unique width which is adapted to engage a groove in a corresponding unique sleeve, could be successively flowed downhole to engage the desired groove in a respective desired sliding sleeve. Upon applied uphole fluid pressure such fluid pressure would cause the dart and associated sliding sleeve to move downhole, thereby causing the associated port to be opened. Such allowed the formation, at the location of the opened port, to be fracked by the injection into the wellbore of pressurized fracking fluid.

After fracking by injection of fracturing fluid under high pressure, the ball plug would typically dissolve, leaving the casing string thereby completed for subsequent production.

Notably, the aforesaid modified prior art methods and systems all required ports be pre provided in the casing string, each with an associated sliding sleeve.

In a later further variation of the aforesaid modified prior art methods and systems, pump-down (not wireline conveyed) darts or collet baffles are employed for purposes of individually opening pre provided ports in the casing string spaced ports along the casing string and simultaneously plugging the casing string of such location. Thereafter high pressure fluid would be injected to carry out fracking of the formation in the region of the opened port(s). After completion of the fracking and after dissolving of the dart member in each of the collet baffles, a wireline-conveyed retrieving tool adapted and configured to pass through each of the collet baffles was employed, which would be lowered beneath the lowermost collet baffle, and subsequent uphole retrieval of the wireline-conveyed retrieval tool would retrieve all of the collet baffles from the casing string, leaving a wide open casing string for subsequent production of hydrocarbons therefrom. Commonly assigned US Pub. 2020/0362661 discloses such a system and method.

Again, like in the modified prior art methods and systems and in the graduated ball-drop methods and systems, these later variations such as described US Pub. 2020/all required pre provided sliding sleeves and associated ports in the casing string.

A real need accordingly exists for an alternative tool, system and method for fracking for use in wellbores which do not have pre-provided ports in the casing and associated sliding sleeves covering such ports, but which avoids the use of expensive packer elements which need to later be milled out.

A real need further exists for a tool, system, and method that may further be used, if desired, in not only pre-production wellbores which do not have pre-provided ports and associated sliding sleeves, but which further may be used to re-frack a wellbore which does not have pre-provided ports, and which wellbore has been previously perforated and fracked, but which is in need of further fracking along its length to thereby re-vitalize and rejuvenate production from such existing wellbore in a hydrocarbon formation.

SUMMARY OF THE INVENTION

The following aspects, features and advantages of the present invention will be further appreciated when considered with reference to the description of preferred embodiments and accompanying drawings, where like reference numerals represent like elements.

The invention broadly relates, in a first aspect, to a collet baffle for use in existing wellbores, where such collet baffle provides an internal sliding sleeve, actuatable by a wireline setting tool, to when actuated retain the collet baffle when at a desired location along a wellbore, to thereby plug the wellbore at such location, and thereafter allow perforating the wellbore uphole of the baffle. Upon removal of the wireline, subsequent fracking of the formation proximate the created perforations in the wellbore may be carried out, and after dissolution of a dart member seated in the collet baffle, production from such fracked wellbore may occur.

The invention further broadly relates to an insertion tool, configured to have releasably coupled thereto a collet baffle and to releasably convey the collet baffle downhole in a casing string via a wireline to a desired location along such wellbore, and in combination with a setting tool, lockingly engage the collet baffle as a desired location in the casing string.

The invention further broadly relates to a system incorporating such collet baffle in an associated insertion tool, along with an associated setting tool.

Lastly, the invention further broadly relates to methods which utilizes such collet baffle, insertion tool, and setting tool.

The invention, and in particular the aspect thereof comprising the collet baffle of the present invention, is particularly suited for use in previously-constructed casing strings, where such casing strings unlike newer designs do not possess pre-provided ports and associated sliding sleeves for opening such ports. The invention permits additional perforation and fracking of a wellbore previously used for production, so as to rejuvenate production from such early-constructed wellbores without having to employ expensive packer elements and without having to later mill out such packers after the additional fracking has been carried out.

Accordingly, in a first broad aspect of the present invention the present invention comprises a collet baffle. The collet baffle is configured so as to be capable of being conveyed downhole in a wellbore via a wireline. It comprises:

- a hollow cylindrical member having an uphole and a downhole end and a bore therethrough;
- a plurality of elongate, longitudinally-extending hollow slots situated in and circumferentially spaced about a cylindrical periphery of the hollow cylindrical member, each extending longitudinally along a portion of said cylindrical periphery of said hollow cylindrical member;
- an annular ring situated on an outer periphery of the hollow cylindrical member and situated approximately intermediate the uphole and downhole end thereof, having a portion protruding radially outwardly from the outer periphery of said hollow cylindrical member, wherein such annular ring is bisected at a plurality of locations thereon by the longitudinally-extending hollow slots, and wherein the annular ring on the hollow cylindrical member is radially inwardly and outwardly resiliently flexible;

a plug member, situated at said downhole end of said hollow cylindrical member and concentrically located within said hollow cylindrical member, which alone or in combination with a dart member subsequently flowed downhole, prevents passage of fluid through said hollow cylindrical member; and an annular hollow locking ring member situated in the bore of the hollow cylindrical member, releasably coupled via first shear means to an inner periphery of said hollow cylindrical member in an initial first position and longitudinally slidable within the bore, which is adapted to be slidably moved when the first shear means are sheared, from the first initial position to a second operative position where a portion of the annular hollow locking ring member underlies a substantial portion of the annular ring.

In one embodiment of such collet baffle the plug member has on an uphole side thereof a plug seat therein for retaining and preventing further downhole movement of a dart member, which dart member when situated in said plug seat, along with the plug seat, then together prevent passage of fluid through the hollow cylindrical member. One or both of the plug seat and/or the dart member are dissolvable in a dissolving fluid.

In another embodiment of the collet baffle, the plug member is a solid member, which by itself entirely prevents passage of fluid through the collet baffle member.

In another embodiment of the collet baffle, a plug member comprises a ball seat, which is situated at the downhole end of said hollow cylindrical member and concentrically located within said hollow cylindrical member. The ball seat, in combination with a dart member subsequently flowed downhole, together prevent passage of fluid through the hollow cylindrical member.

In a preferred embodiment, the annular ring further has a portion thereof protruding radially inwardly from an inner periphery of the hollow cylindrical member, and the annular locking ring member has, over a portion of an outer periphery thereof, a segment of a reduced diameter adjoining a segment of greater diameter, which segment of reduced diameter when said annular locking ring member is slidably moved from said first initial position to said second operative position, directly underlies said portion of said annular ring which extends radially inwardly. When the annular hollow locking ring member is in said second operative position, the segment of greater diameter abuts said portion of said annular ring protruding radially inwardly and thereby prevents further slidable movement of said annular hollow locking ring member in a direction from said first initial position to said second operative position.

In a further refinement of the aforesaid preferred embodiment, the segment of reduced diameter on the annular locking ring member is situated on a downhole side of the annular hollow locking ring member, and the segment of greater diameter is located proximate an uphole end of the annular hollow locking ring member. Such allow, upon extension of a push rod from the setting tool, the setting tool to move the annular hollow locking ring member downhole and in particular its segment of lesser diameter to a position immediately underlying the annular ring on the hollow cylindrical member, and to be prevented from further downhole movement by the segment of greater diameter then abutting the annular hollow locking ring member.

In a further preferred embodiment, the annular hollow locking ring member is releasably coupled to said hollow cylindrical member in said first initial position by at least one shear pin or shear screw.

In still further preferred embodiment, one or both of the annular hollow locking ring member and/or the plug seat of the collet baffle are dissolvable in a dissolving fluid.

In a still further preferred embodiment, the hollow cylindrical member further possesses at least one shear screw situated in said periphery thereof proximate said uphole end thereof, for releasably affixing the collet baffle to a wireline conveying tool.

In another broad aspect of the invention, the invention comprises a tool for facilitating fracking operations within a hydrocarbon formation and configured so as to be coupleable, at an uphole end thereof, to a wireline-conveyed setting tool, comprising:

a collet baffle as described in one or more of the aforementioned embodiments;

a substantially cylindrical release shoe, comprising:

i) an outer cylindrical member, a downhole portion of which is adapted to be coupled, via second shear means, to an inner periphery of said collet baffle proximate an uphole end thereof; and ii) a coaxial piston member situated in and slidably moveable within said outer cylindrical member and initially prevented from longitudinal sliding movement therein by being coupled thereto via third shear means; and wherein a distal end of the co-axial piston member, when a displacing force is applied to said co-axial piston member via a setting tool, contacts the annular hollow locking ring member of said collet baffle and shears the third shear means and causes the annular locking ring member to move downhole from the first initial position to the second operative position.

In a preferred embodiment of the above tool of the present invention the coaxial piston member has affixed to a downhole end thereof a push ring member. The push ring member when the force is applied to the co-axial piston member by the setting tool, causes the annular hollow locking ring member to move from the initial first position to the second operative position.

In a further broad aspect of the invention, the invention comprises a wireline-conveyed system for perforating a wellbore and subsequently conducting fluid injection in a wellbore. Specifically, such wireline-conveyed system comprises:

a collet baffle as described in one or more of the embodiments set out above;

a substantially cylindrical release shoe, comprising:

i) an outer cylindrical member, a downhole portion of which is adapted to be coupled, via second shear means, to an inner periphery of the collet baffle proximate an uphole end thereof; and ii) a coaxial piston member situated in and slidably moveable within said outer cylindrical member and initially prevented from longitudinal sliding movement therein by being coupled thereto via third shear means;

wherein a distal end of the co-axial piston member, when a displacing force is applied to the co-axial piston member via a setting tool, contacts the annular hollow locking ring member of the collet baffle and shears the third shear means and causes the annular locking ring member to move downhole from the first initial position to said second operative position;

a wireline;

a wireline-conveyed setting tool, coupled at a downhole end thereof to an uphole end of the substantially cylindrical release shoe; and one or more electrically-actuated explosive charges positioned along said wireline proximate said setting tool and immediately uphole of said setting tool.

In a further broad aspect of the invention, the invention comprises a method for perforating and performing fluid treatment of a wellbore, such method comprising the steps of:

(i) forming a casing string comprised of a plurality of hollow pipes threadably connected to each other at casing subs, each of said casing subs threadably connecting pairs of pipes together and having an annular interior circumferential groove therein of a given width;

(ii) forming said casing string in a wellbore;

(iii) running a wireline down said casing string, said wireline having at a distal end thereof:

(a) a collet baffle as described above, and having a plug member or dart located at a downhole end thereof which initially entirely obstructs flow of fluid through the collet baffle;

(b) a substantially cylindrical release shoe, comprising:

i) an outer cylindrical member, a downhole portion of which is adapted to be coupled, via second shear means, to an inner periphery of said collet baffle of claim 1 proximate an uphole end thereof; and ii) a coaxial piston member situated in and slidably moveable within said outer cylindrical member and initially prevented from longitudinal sliding movement therein by being coupled thereto via third shear means;

wherein a distal end of said co-axial piston member, when a displacing force is applied to said co-axial piston member via a setting tool, contacts said annular hollow locking ring member of said collet baffle and shears said third shear means and causes said annular locking ring member to move downhole from said first initial position to said second operative position;

(c) a setting tool, coupled at a downhole end thereof to an uphole end of said substantially cylindrical release shoe; and (d) one or more electrically-actuated explosive charges positioned along said wireline proximate said setting tool and immediately uphole of said setting tool;

(iv) running said wireline down said casing string to a location in said casing string proximate a distal end thereof, wherein said portion of said annular ring protruding radially outwardly from said outer periphery of said hollow cylindrical member directly overlies said annular interior circumferential groove in a most distal of said casing subs;

(v) actuating said setting tool to cause said setting tool to extend a push rod to contact said a coaxial piston member of said release shoe, shear said second shear means, and force said co-axial piston member to contact said annular hollow locking ring member and thereafter shear said first shear means and force said annular hollow locking ring member to move from said first initial position to said second operative position where said annular ring operatively engages and is retained within said annular interior circumferential groove in a most distal of said casing subs so as to retain said collet baffle within said most distal casing sub;

(vi) pulling uphole on said wireline and causing said third shear means to shear and thereby allow the wireline, explosive charges, setting tool, and release shoe to be pulled uphole to a desired position for creating perforations in said casing string;

(vii) actuating said explosive charges to create perforations in said casing string;

(viii) withdrawing said wireline, setting tool, and release shoe from said casing string;

(ix) pumping a treating fluid downhole in the casing string and causing it to flow into a hydrocarbon formation via said perforations in said casing string.

In a variation of the above method, each and all of the first, second, and third shear means are caused to shear at the time of actuation of the setting tool. Accordingly, in such variation of the above method, steps (v) and (vi) alternatively comprise the steps of:

(v) actuating said setting tool to cause said setting tool to extend a push rod to contact said a coaxial piston member of said release shoe, shear said second shear means and said third shear means, and force said co-axial piston member to contact said annular hollow locking ring member and thereafter shear said first shear means and thereby force said annular hollow locking ring member to move from said first initial position to said second operative position where said annular ring operatively engages and is retained within said annular interior circumferential groove in a most distal of said casing subs so as to retain said collet baffle within said most distal casing sub;

(vi) pulling uphole on said wireline thereby allow the wireline, explosive charges, setting tool, and release shoe to be pulled uphole to a desired position for creating perforations in said casing string;

In a refinement of each of the above methods, such method further comprises the further comprising the steps, after step (ix), of:

running a wireline down said casing string having the features of (a)-(d) of step (iii) above to a location wherein the annular ring of the collet baffle on the wireline directly underlies said circumferential interior annular groove in a penultimate of said casing subs in said casing string;

repeating steps (v) to (ix) in said method so as to perform a fluid treating step in the hydrocarbon formation at a second location along the casing string.

In a further broad aspect of the invention, the invention comprises a modified method for perforating and performing fluid treatment of a wellbore by injecting a fracking fluid under pressure, which modified method utilizes a collet baffle only having a plug seat and not a plug member, which plug seat initially does not by itself obstruct flow of liquid through the collet baffle. In this modified method a ball or dart member is later pumped down immediately prior to fracking, in order to temporarily obstruct flow past the baffle member and cause the injected fluid to then flow through the created perforations in the casing string immediately above the plug seat, and then into the formation. Such modified method comprising such embodiment of the collet baffle of the present invention comprises the steps of:

(i) forming a casing string comprised of a plurality of hollow pipes threadably connected to each other at casing subs, each of said casing subs threadably connecting pairs of pipes together and having an annular interior circumferential groove therein of a given width, and situating said casing string in a wellbore;

(ii) running a wireline down said casing string, said wireline having at a distal end thereof:

(a) a collet baffle as claimed in claim 1, further including a dart member seated in said plug seat;

(b) a substantially cylindrical release shoe, comprising:

i) an outer cylindrical member, a downhole portion of which is adapted to be coupled, via second shear means, to an inner periphery of said collet baffle of claim 1 proximate an uphole end thereof; and ii) a coaxial piston member situated in and slidably moveable within said outer cylindrical member and initially prevented from longitudinal sliding movement therein by being coupled thereto via third shear means;

wherein a distal end of said co-axial piston member, when a displacing force is applied to said co-axial piston member via a setting tool, contacts said annular hollow locking ring member of said collet baffle and shears said third shear means and causes said annular locking ring member to move downhole from said first initial position to said second operative position;

(c) a setting tool, coupled at a downhole end thereof to an uphole end of said substantially cylindrical release shoe; and (d) one or more electrically-actuated explosive charges positioned along said wireline proximate said setting tool and immediately uphole of said setting tool;

(iii) running said wireline down said casing string to a location in said casing string proximate a distal end thereof, wherein said portion of said annular ring protruding radially outwardly from said outer periphery of said hollow cylindrical member directly overlies said annular interior circumferential groove in a most distal of said casing subs;

(iv) actuating the setting tool to cause the setting tool to extend a push rod to contact the coaxial piston member, shear the second shear means, and force the co-axial piston member to contact the annular hollow locking ring member and thereafter shear the first shear means and force said annular hollow locking ring member to move from said first initial position to said second operative position where said annular ring operatively engages and is retained within said annular interior circumferential groove in the most distal of said casing subs so as to retain said collet baffle within said most distal casing sub;

(v) pulling uphole on said wireline and causing the third shear means to shear and thereby permitting the wireline, explosive charges, setting tool and release shoe to be pulled uphole to a desired position for creating perforations in said casing string;

(vi) actuating said explosive charges to create perforations in said casing string;

(vii) withdrawing said wireline, setting tool, and release shoe from said casing string;

(viii) flowing a plug member down the casing string and causing the plug member to become seated in the plug seat of the collet baffle; and (ix) pumping a treating fluid downhole in the casing string and causing it to flow into a hydrocarbon formation via said perforations in said casing string;

Again, in a variation of the above immediately-preceding method, each and all of the first, second, and third shear means are caused to shear at the time of actuation of the setting tool. Accordingly, in such variation of the above method, steps (v) and (vi) alternatively comprise the steps of:

(v) actuating said setting tool to cause said setting tool to extend a push rod to contact said a coaxial piston member of said release shoe, shear said second shear means and said third shear means, and force said co-axial piston member to contact said annular hollow locking ring member and thereafter shear said first shear means and thereby force said annular hollow locking ring member to move from said first initial position to said second operative position where said annular ring operatively engages and is retained within said annular interior circumferential groove in a most distal of said casing subs so as to retain said collet baffle within said most distal casing sub;

(vi) pulling uphole on said wireline thereby allow the wireline, explosive charges, setting tool, and release shoe to be pulled uphole to a desired position for creating perforations in said casing string;

In a refinement of the above modified method, such modified method may further comprise the further steps, after step (ix), of:

running a wireline down said casing string having the features of (a)-(d) of step (ii) above to a location wherein the annular ring of the collet baffle on the wireline directly underlies said circumferential interior annular groove in a penultimate of said casing subs in said casing string;

repeating steps (iv) to (ix) in said method so as to perform a fluid treating step in the hydrocarbon formation at a second location along the casing string.

BRIEF DESCRIPTION OF THE DRAWINGS

The following non-limiting examples of the invention in some of its various aspects are shown in the following drawings, of which:

FIGS. 1A-1L show a series of steps in one of the methods of the prior art ("plug and perf") for the perforating and fracking a wellbore (ie. the completion of a wellbore) in order to ready the wellbore for production, wherein:

FIG. 1A is a view of an initial created casing string, having a series of casing subs regularly spaced along the length of the casing string;

FIG. 1B is a view of the step in the aforesaid "plug and perf" prior art method of affixing a commercially-available expandable packer element to a commercially-available setting tool which itself has explosive charges associated with it, and attaching such assembly of elements to a wireline and lowering such wireline in the casing string to a lowermost casing sub;

FIG. 1C is a schematic view of the step in the aforesaid prior art method, comprising the subsequent step of actuating the commercially-available expandable packer element via the setting tool on the wireline and causing the expandable packer element to expand and thereby seal the casing string;

FIG. 1D is a schematic view of the step in the aforesaid prior art method of "plug and perf" of then decoupling the expandable packer element from the wireline and setting tool, and moving the setting tool, explosive charges, and wireline uphole to a desired position along the casing string where a first fracking operation is desired to be conducted, and the explosive charges detonated so as to perforate the casing in such desired location;

FIG. 1E is a schematic view of the step in the prior art of removing the wireline and setting tool, and subsequently pumping fluid into the wellbore and the hydrocarbon formation at the location of the created perforations;

FIGS. 1F-1J essentially schematically illustrate the same series of respective successive steps in the prior art as shown in respective FIGS. 1B-1E, but such series of steps being now carried out in the region in the casing string and wellbore proximate a more uphole (penultimate) casing sub;

FIG. 1K is a view of the completed wellbore, after the above prior art method has been repeated in each of the regions in the casing string at which the casing subs are located; and FIG. 1L is a view of the completed wellbore, when production is occurring.

FIG. 2A-2D show one embodiment of the collet baffle of the present invention, wherein:

FIG. 2A is a perspective exterior view of the collet baffle of the present invention;

FIG. 2B is a partial cross-sectional view of the collet baffle of the present invention shown in FIG. 2A;

FIG. 2C is a similar cross-sectional view of the collet baffle of the present invention shown in FIG. 2A, where the annular hollow ring member has been repositioned from its first initial position to its second operative position substantially underlying the annular ring;

FIG. 2D is a similar cross-sectional view of the collet baffle of the present invention shown in FIG. 2A, in an embodiment where both the annular hollow ring member and the plug seat and dart member(ball) are dissolvable in a corrosive fluid, and such components have been so exposed and been dissolved;

FIGS. 15A-15L show a series of steps in one of the methods of the present invention for perforating and fracking a wellbore (ie. the completion of a wellbore) in order to ready the wellbore for production, wherein:

FIG. 15A is a view of an initial casing string, having a series of segments of hollow pipe threadably secured together via casing subs, having a plurality of longitudinally-spaced circumferential grooves regularly spaced along the length of the casing string;

FIG. 15B is a view of a step in the aforesaid method of affixing a collet baffle of the present invention to a commercially-available setting tool which itself has explosive charges associated with it, and lowering such assembly of elements in the casing string via a wireline to a distal end of such casing string, where an annular ring on the collet baffle engages a lowermost circumferential groove in the casing string;

FIG. 15C is a schematic view of a step in the aforesaid prior art method, comprising actuating the setting tool on the wireline and causing the annular hollow locking ring member within the collet baffle to be moved from a first initial position to a second operative position underlying the annular ring and thereby locking the annular ring in locked engagement with such lowermost circumferential groove;

FIG. 15D is a schematic view of the step in the method of the present invention of pulling the setting tool, explosive charges, and wireline uphole to a desired position along the casing string where a first fracking operation is desired to be conducted, and detonating one or more of the explosive charges to perforate the casing in such desired location;

FIG. 15E is a schematic view of the step in the method of the present invention t of removing the wireline and setting tool from the casing string and subsequently pumping fluid into the wellbore and the hydrocarbon formation at the location of the created perforations;

FIGS. 15F-15J essentially schematically illustrate the same series of respective successive steps in the prior art as shown in respective FIGS. 15B-15E, but such series of steps being now carried out in the region in the casing string and wellbore proximate a more uphole (penultimate) casing sub;

FIG. 15K is a view of the completed wellbore, after the above prior art method has been repeated in each of the regions in the casing string at which the casing subs are located; and FIG. 15L is a view of the completed wellbore, when production is then occurring.

DETAILED DESCRIPTION OF SOME PREFERRED EMBODIMENTS

In describing the preferred embodiments of the invention illustrated in the appended drawings, specific terminology will sometimes be used for sake of clarity. However, it is to be understood that the specific terminology is not intended to be limiting and that each specific term includes equivalents or variants that operate in a similar manner to accomplish a similar purpose.

The "plug and perf" prior art method was typically employed in the prior art and still is used today in association with wellbores that do not have pre-formed ports and associated sliding sleeves. It is explained below by way of reference to figures herein, in order to provide context and background for the collet baffle, tool comprising such collet baffle, the system, and the method of the present invention.

In this regard, FIGS. 1A-1K illustrate successive discrete steps in the prior art 'plug and perf' method.

Figures 1A, 1B, 1C, 1D, 1E:
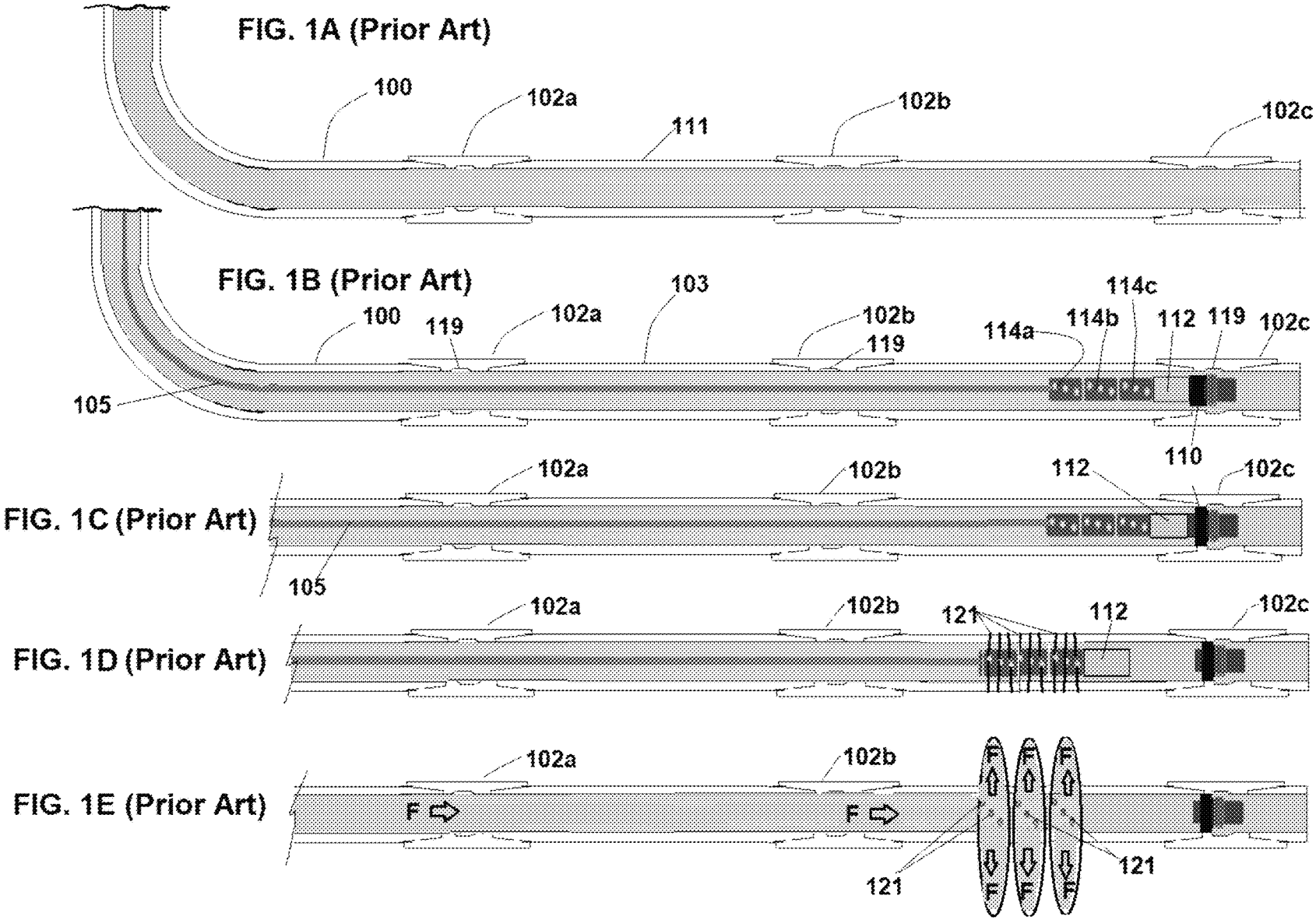
FIG. 1A (Prior Art)
FIG. 1B (Prior Art)
FIG. 1C (Prior Art)
FIG. 1D (Prior Art)
FIG. 1E (Prior Art)

As best shown in FIG. 1A, wellbores to which the "plug and perf" method is suited will typically comprise a plurality of segments of hollow pipe or casing 100. Pipe segment pairs 100 are threadably coupled together (typically at the time of drilling in a hydrocarbon formation) by individual casing sub members 102*a*, 102*b*, 102*c* similarly threaded at their respective ends, to thereby form a cased wellbore 103 which typically thereafter has cement injected downhole which cement then flows up the annulus (not shown) between the casing and the drill hole in the formation, to thereby seal the casing 103 in the drill hole along substantially the length of the casing string 103.

In order to ready the casing 103 for production of hydrocarbon from the formation containing the wellbore, the following steps depicted in FIGS. 1B-1K are further sequentially performed.

Firstly, as may be see in FIG. 1B, a wireline 105, having at a distal end thereof an actuatable packer element 110, a wireline-actuated setting tool 112, and a plurality of wireline actuated perforating guns 114*a*, 114*b*, and 114*c* each containing explosive charges, are thereafter lowered or flowed into the casing string 103 to a location approximate the most distal end or most distal casing sub 102*c*. Often there will be circumferential groove 119 within each casing sub members 102*a*, 102*b*, 102*c* of consistent uniform width, as shown.

Thereafter, and as may be seen in FIG. 1C, the wireline-actuated setting tool 112 is actuated by sending an electrical signal from surface down wireline 105, causing a push rod in setting tool 112 to be extended downhole thereby actuating packer element 112 and causing packer element 112 to expand and sealingly engage the inner sidewalls of wellbore casing string 103.

Thereafter, and as may be seen in FIG. 1D, the setting tool 112 is caused, via signals run along wireline 105, to disengage from packer element 110, and the wireline 105 (now having only the perforating guns 114*a*, 114*b*, and 114*c* and setting tool 112 at its distal end) is then pulled slightly uphole to a location of desired fracturing. One or more of perforating guns 114*a*, 114*b*, and 114*c* are actuated to perforate the casing. Such step may be repeated a number of times, moving the perforating guns slightly uphole in discrete increments depending on the number of perforating guns 114*a*, 114*b*, and 114*c*, and a number of perforations 121 thus created until all desired perforations 121 have been created at such location and all corresponding perforating guns 114*a*, 114*b*, and 114*c* having been actuated.

Thereafter, and as may be seen in FIG. 1E, the wireline 105 (now having only the perforating guns 114*a*, 114*b*, and 114*c* and setting tool 112 at its distal end) is withdrawn from the casing string 103. A fracking fluid "F" under high pressure is then pumped downhole in the casing string and out into the formation via the created perforations 121, causing fissures 113 in the formation at such location along the wellbore/casing string 103.

Each of the aforementioned series of steps depicted in FIGS. 1B-1E are again repeated with respect to fracturing the formation in and around the next uphole casing sub member 102*b*.

Figures 1F, 1G, 1H, 1J:
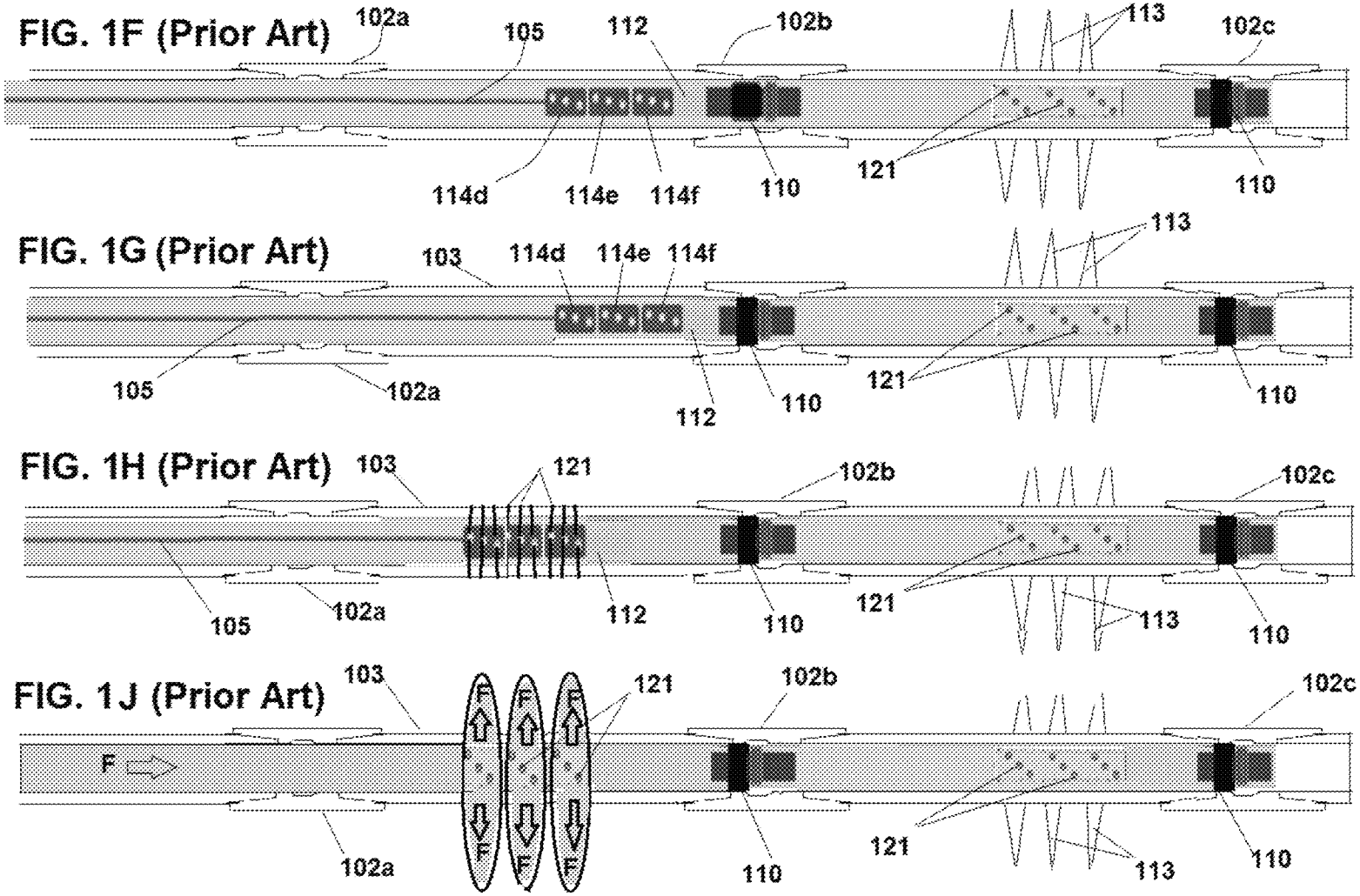
FIG. 1F (Prior Art)
FIG. 1G (Prior Art)
FIG. 1H (Prior Art)
FIG. 1J (Prior Art)

Specifically, and as may be seen in subsequent FIG. 1F, wireline 105, having at a distal end thereof a further actuatable packer element 110, a wireline-actuated setting tool 112, and a plurality of wireline-actuated perforating guns 114*d*, 114*e*, and 114*f* each containing explosive charges, is then lowered into casing string 103 to a location where the distal end thereof is approximate casing sub 102*b*.

Thereafter, and as may be seen in FIG. 1G, the wireline-actuated setting tool 112 is actuated by sending an electrical signal from surface down wireline 105, causing a push rod in setting tool 112 to be extended downhole thereby actuating packer element 112 and causing packer element 112 to expand and sealingly engage the inner sidewalls of wellbore casing string 103.

Thereafter, and as may be seen in FIG. 111, the setting tool 112 is caused, via signals run along wireline 105, to disengage from packer element 110, and the wireline 105 (now having only the perforating guns 114*d*, 114*e*, and 114*f* and setting tool 112 at its distal end) is then pulled slightly uphole to another location of desired fracturing along casing string 103. One or more or all of perforating guns 114*d*, 114*e*, and 114*f* are actuated to perforate the casing 103. If only one of perforating guns is actuated, such step may be repeated a number of times, moving the perforating guns slightly uphole in discrete increments depending on the number of perforating guns 114*a*, 114*b*, and 114*c*, and perforations 121 thus created at each discrete location until all desired perforations 121 have been created at in such region and all corresponding perforating guns 114*a*, 114*b*, and 114*c* having been actuated.

As may be seen in FIG. 1I, the wireline 105 (now having only the perforating guns 114*d*, 114*e*, and 114*f* and setting tool 112 at its distal end) is then withdrawn from the casing string 103. A fracking fluid "F" under high pressure is then pumped downhole in the casing string and out into the formation via the created perforations 121, causing fissures 113 in the formation at such location along the wellbore/casing string 103

Figure 1K:
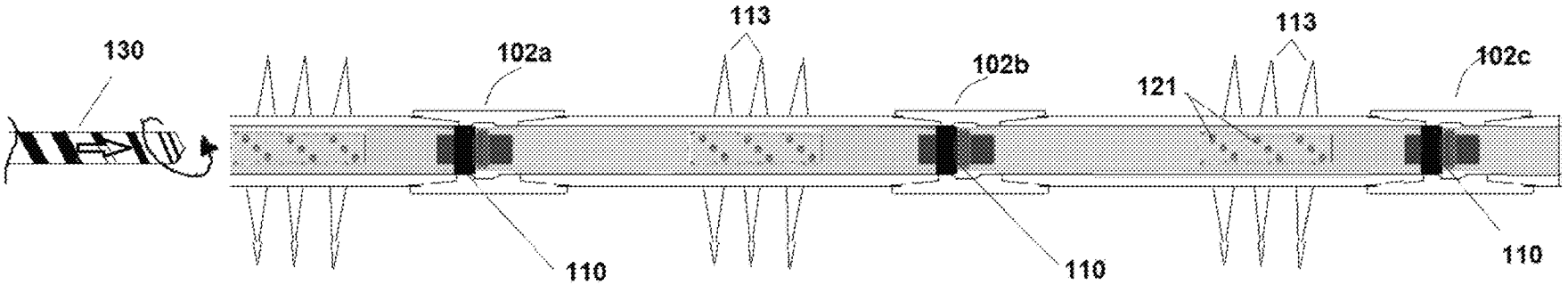
FIG. 1K (Prior Art)

In a subsequent step, as may be seen in FIG. 1K, a milling or reaming tool 130 is run down the casing string 103, and all actuated packers are milled out to open the casing string 103 for production.

Figure 1L:
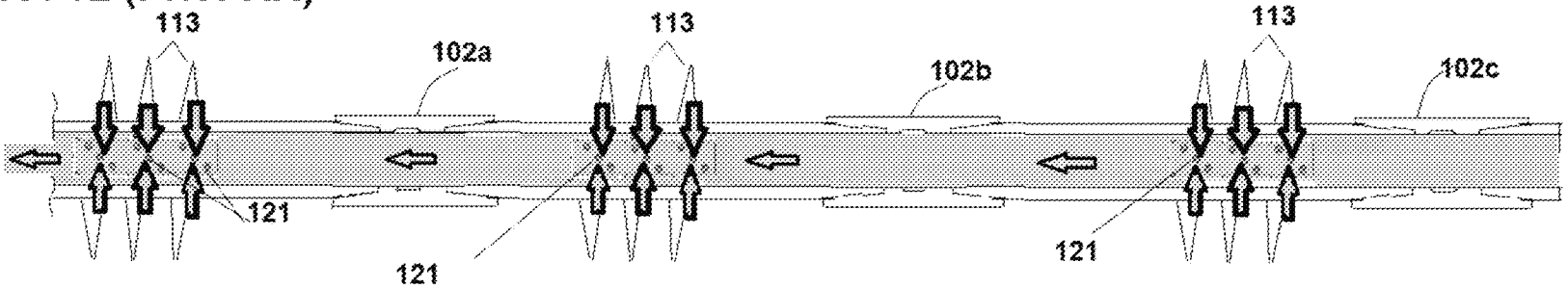
FIG. 1L (Prior Art)
Figure 3:
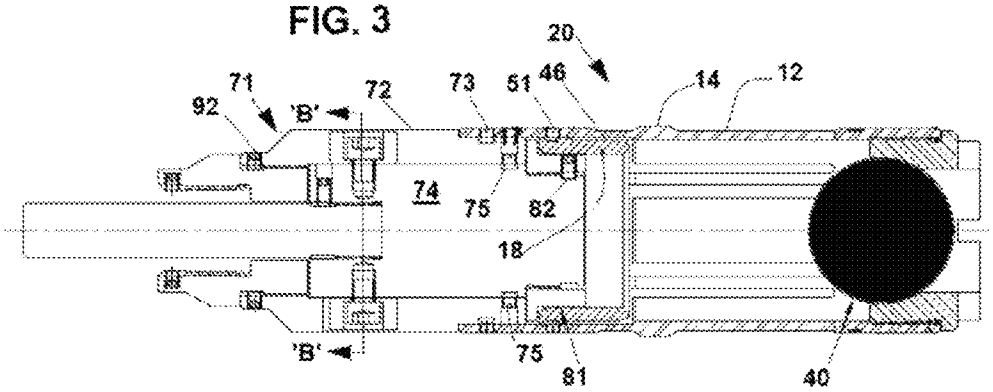
FIG. 3 is a cross-sectional view of the downhole tool of the present invention releasably coupled to a collet baffle of the present invention, in an embodiment where the tool has a plug member initially positioned in the distal (most downhole) end of the baffle member.
Figure 4B:
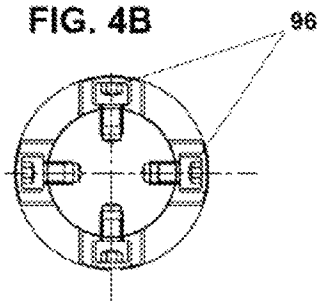
FIG. 4B is a view along plane 'B'-'B' of FIG. 4.
Figure 4:
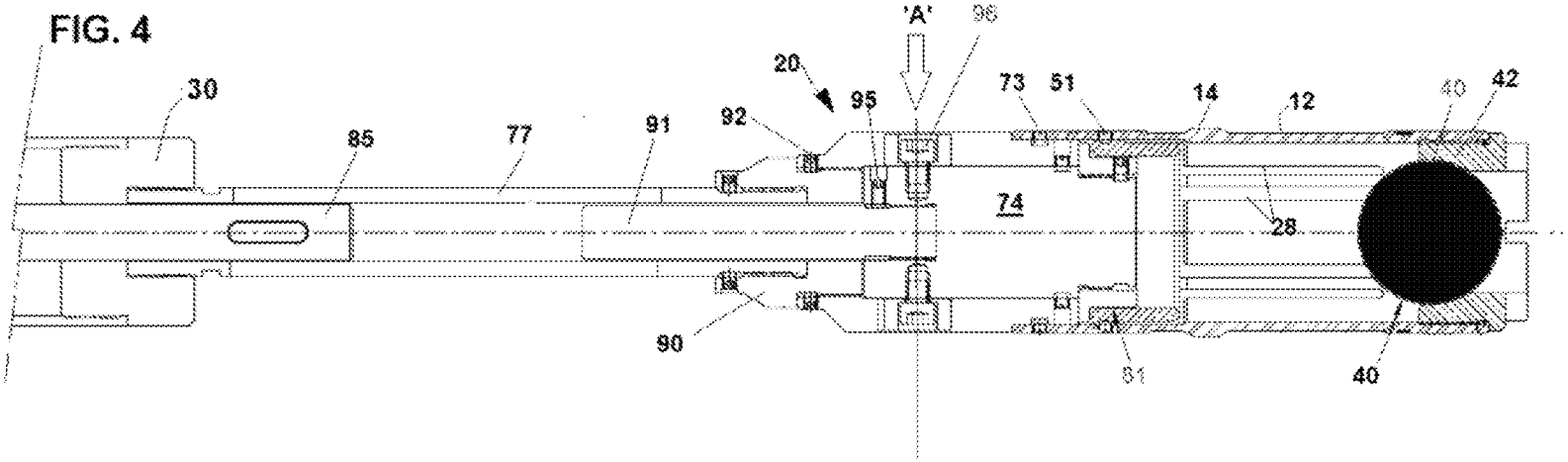
FIG. 4 is a cross-sectional view of the downhole tool of the present invention releasably coupled to a collet baffle, wherein the uphole end of the tool is further coupled to a downhole end of a setting tool on a wireline; a plug member initially positioned in the distal (most downhole) end of the baffle member, again in the embodiment where the tool has a plug member initially positioned in the distal (most downhole) end of the baffle member.
Figure 4A:
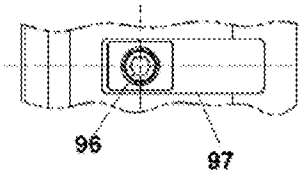
FIG. 4A is a view on arrow 'A" in FIG. 4.

Thereafter, as may be seen in FIG. 1L, hydrocarbons may flow into the fissures 113 created in the formation and into the casing string 103 via created perforations The "plug and perf" method as shown in FIGS. 1A-1L has the drawback that packer elements 110 used as part of such prior art method and which serve to seal the casing string 103 immediately prior to for each fracking step, after being actuated, necessarily then had to remain in casing string 103 and were thus later required to be milled out using an inserted milling tool 130 before production from the wellbore could take place. The packer elements are expensive generally require extensive milling to remove.

The present invention, by its configuration, avoids the step of having to utilize composite packer elements, and the further step and expense of having to destroy same by having to mill them in order to prevent them, once actuated during the fracking operation, from thereafter plugging the wellbore and preventing production.

FIG. 2A-2D show one embodiment of the collet baffle 10 of the present invention, which in all of its embodiments is configured so as to be capable of being conveyed downhole in a wellbore 100 and casing string 103 via a wireline 105.

Specifically, as may be seen from the perspective view thereof in FIG. 2A, and successive partial cross-sectional views in FIGS. 2B-2D, collet baffle 10 comprises a hollow cylindrical member 12 having a bore 25 and an uphole end 26 and a downhole end 27. A plurality of elongate, longitudinally-extending hollow slots 28 are situated in and circumferentially spaced about a cylindrical periphery of hollow cylindrical member 12. Each slot 28 extends longitudinally along a portion of the cylindrical periphery of hollow cylindrical member 12.

An annular ring 14 is situated on an outer periphery of hollow cylindrical member 12 approximately intermediate uphole end 26 and downhole end 27. Annular ring 14 has a portion 31 protruding radially outwardly from the outer periphery of hollow cylindrical member 12. Annular ring 14 bisected at a plurality of locations 32 by longitudinally-extending hollow slots 28. Due to hollow slots 28 bisecting annular ring 28, the radially outwardly portion 31 of annular ring 14 is radially inwardly and outwardly resiliently flexible.

A plug member 42 is threadably affixed via threads 49 at downhole end 27 of hollow cylindrical member 12 to cylindrical member 12 and concentrically located therewithin. Plug member 42 has on an uphole side thereof a plug seat 43 therein for retaining and preventing further downhole movement of a dart member 40, which in a preferred embodiment is a spherical ball. Dart member 40 when situated in plug seat 43, along with plug member 42, together prevent passage of fluid through said hollow cylindrical member 12. In a preferred embodiment, dart member 40 and plug member 42 including plug seat 43, are each formed of a material, such as magnesium, which is subject to corrosion and is dissolvable when exposed to a corrosive fluid, such as acids, which may be contained in fracking fluid. In a further preferred embodiment, dart member 40 is a spherical ball, which may be flowed down the wellbore or alternatively may be initially inserted and seated in the plug seat 43 of the plug member 42 of collet baffle 10 when flowed downhole in casing string 103.

Figures 5, 6, 7:
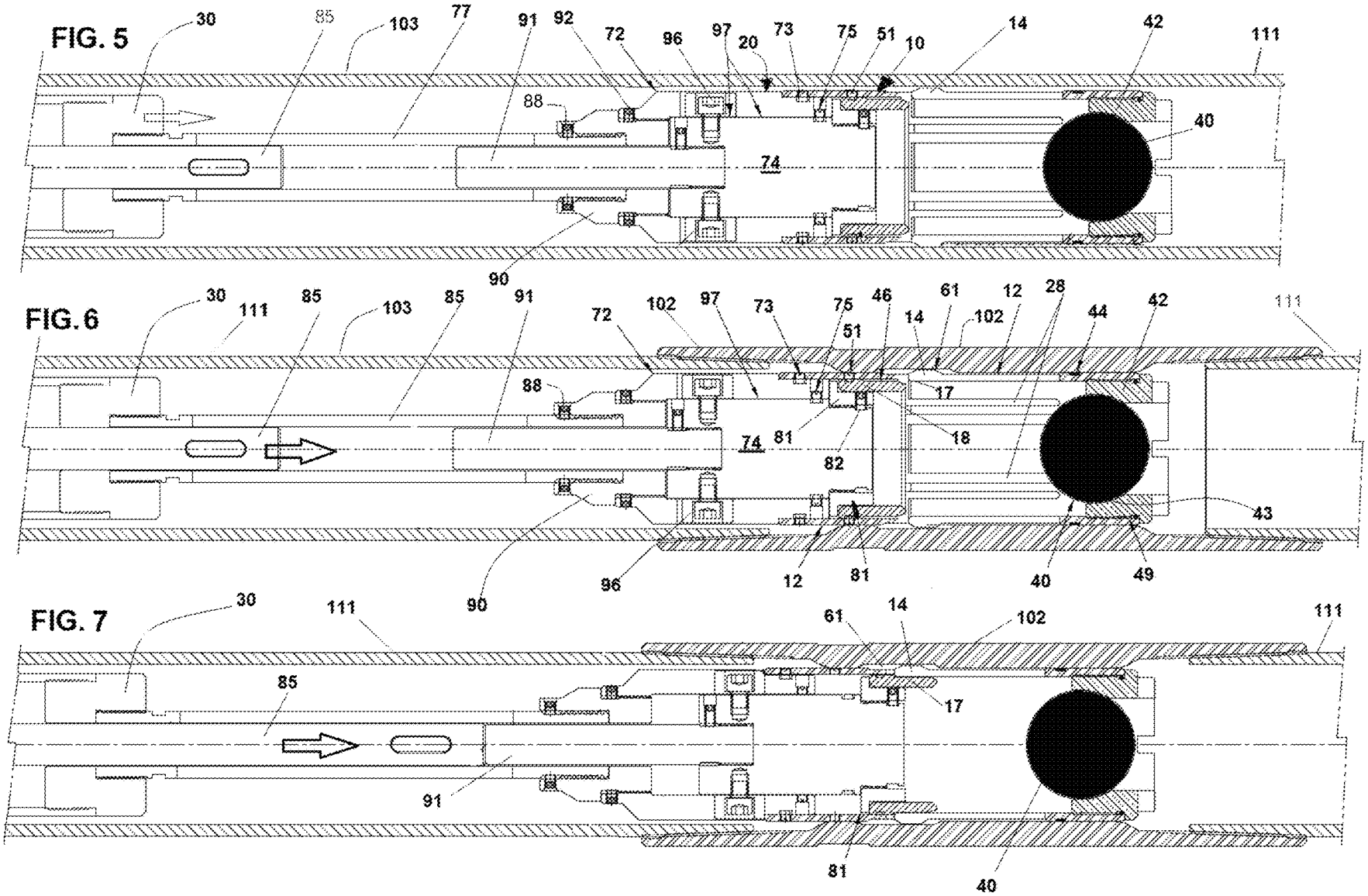
FIG. 5 is a cross-sectional view of the downhole tool of FIG. 4 when located in and being lowered downhole in a casing string.
FIG. 6 is a cross-sectional view of the downhole tool of FIG. 4 upon the downhole tool, and in particular the collet baffle portion thereof, having reached a desired casing sub in the casing string, and the annular ring of the collet baffle having engaged and been positioned immediately beneath the interior circumferential groove in the casing sub.
FIG. 7 is a cross-sectional view of the downhole tool of FIG. 4, where the conventional wireline setting tool has been actuated to extend a push rod thereon, and thereby caused the annular piston member of the downhole tool to reposition the annular hollow locking ring member downhole and from its first initial positon to its second operative position directly underlying the annular ring of the collet baffle, thereby securing the collet baffle to the interior of the casing sub and preventing further movement of the collet baffle relative to such casing sub.

An annular hollow locking ring member 18 is situated in bore 25 of hollow cylindrical member 12, as best seen in FIGS. 2A & 2B. Annular hollow locking ring member 18 is releasably coupled when in an initial first position as shown in FIG. 2A and FIG. 7 via first shear means, which in a preferred embodiment comprises one or more shear screws 51, to an inner periphery of hollow cylindrical member 12. Annular hollow locking ring member 18 is longitudinally slidable within bore 25 and adapted to be slidably moved, when said first shear means 51 are sheared, from said first initial position as shown in FIG. 2B to a second operative position as shown in FIG. 2C where a portion 46 of annular hollow locking ring member 18 underlies a substantial portion of said annular ring 14, and serves to then retain annular ring 14 of collet baffle 10 within and engaged with a circumferential groove 61 within casing string 103, as best seen in FIG. 5-7.

Figure 8:
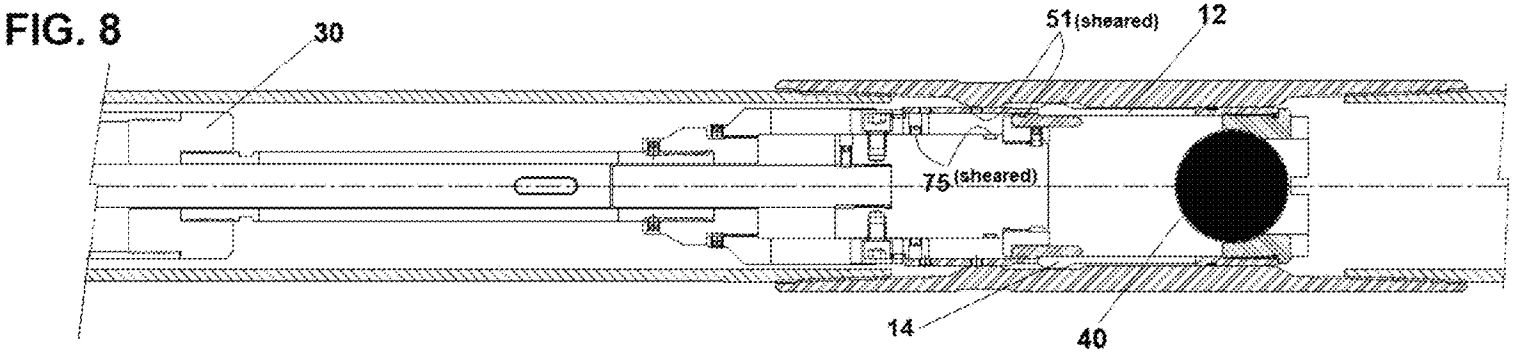
FIG. 8 is a cross-sectional view of the downhole tool of FIG. 4, where the wireline and attached setting tool including the release shoe have been moved slightly uphole and shows the embodiment of the method where such action has further then caused the third shear means to shear.
Figure 9:
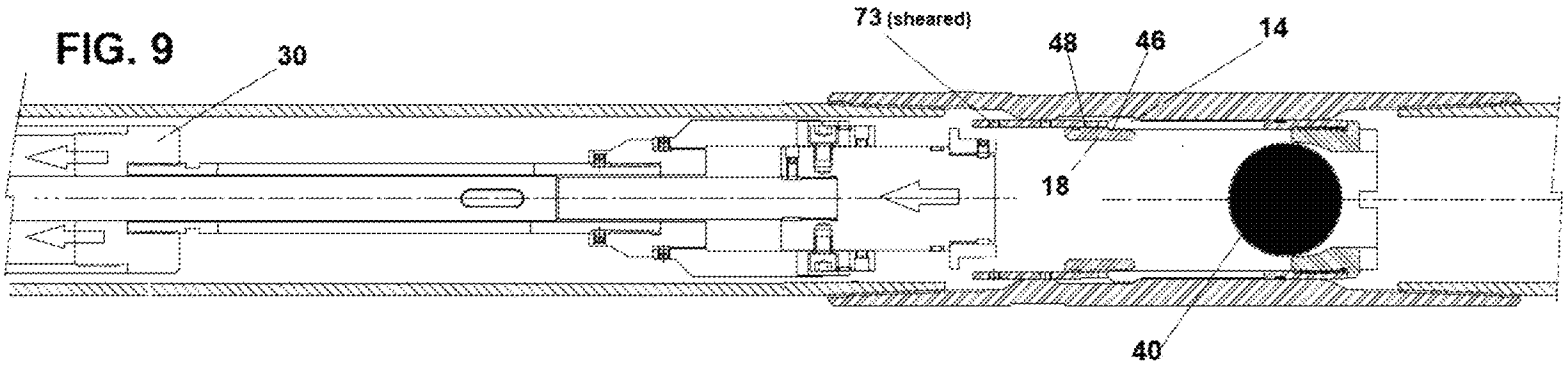
FIG. 9 is a cross-sectional view similar to FIG. 8, where the wireline and attached setting tool have been moved further uphole, and the collet baffle been released from the downhole tool and remains longitudinally fixedly secured via the annular ring and annular locking ring to and within the desired casing sub member.

In a preferred embodiment, annular ring 14 further has a portion 17 thereof protruding radially inwardly and more inwardly than an inner periphery of hollow cylindrical member 12. Annular hollow locking ring member 18 further has, over a portion of an outer periphery thereof, a segment of a reduced diameter 46 adjoining a segment of greater diameter 48, which segment of reduced diameter 46 when annular hollow locking ring member 18 is slidably moved from said first initial position (ref. FIG. 2A and FIG. 7) to the second operative position (ref. FIG. 2B and FIG. 8) directly underlies the portion 17 of annular ring 14 which extends radially inwardly. In addition, when annular hollow locking ring member 18 is in the second operative position, the segment of greater diameter 48 abuts the portion 17 of annular ring 14 protruding radially inwardly (ref. FIG. 2B and FIG. 8) and thereby prevents further slidable movement of said annular hollow locking ring member in a direction from said first initial position to said second operative position.

In a further refinement of such preferred embodiment, segment 46 of reduced diameter on annular hollow locking ring member 18 is situated on a downhole side of annular hollow locking ring member 18, and segment 48 thereon of greater outer diameter is located proximate an uphole side of annular hollow locking ring member 18, as seen for example in FIGS. 6 & 7.

In a preferred embodiment, the annular hollow locking ring member 18 may be formed of a dissolvable metal, such as magnesium, which is dissolvable in a corrosive fluid such as hydrochloric acid. Advantageously, this allows annular hollow locking ring member 18, once fracking has been completed, upon dissolving liquids in such fracking fluid acting thereon to cause such locking ring member 18 to become dissolved, thereby further opening bore 25 of collet baffle 10, to allow increased flow of fluid therethrough. A n "o" ring seal 44 may further be provided, to assist, along with flow-down ball 40, in preventing during fracking operation as for example shown in FIG. 10 fracking fluid from passing downhole and ensure fracking fluid passes into the hydrocarbon formation as shown for example in FIG. 10

In another aspect of the invention, an insertion or adapter tool 20 as best shown in FIGS. 3 and FIGS. 4-9 is provided, adapted for conveying inter alia collet baffle 10 downhole in a casing string 103, where such casing string 103 is formed by a series of hollow pipe members 111 threadably coupled together via casing sub-members 102.

Tool 20 comprises not only the collet baffle 10 described above, but further comprises a substantially cylindrical release shoe assembly 71, for the purpose of adapting the collet baffle 10 to be releasably attached to a setting tool, and to be conveyed downhole to a desired location in a casing string 102. Release shoe assembly 71 comprises:

i) an outer cylindrical member 72, a downhole portion of which is adapted to be coupled, via second shear means (typically in the form of shear screws 73) to an inner periphery of collet baffle 10 proximate an uphole end thereof; and ii) a coaxial piston member 74 situated in and slidably moveable within said outer cylindrical member 72 and initially prevented from longitudinal sliding movement therein by being coupled thereto via third shear means, typically in the form of additional third shear screws 75.

A distal end of said co-axial piston member 74, when a displacing force is applied to coaxial piston member 74 by setting tool 30 in the manner more fully explained below, causes each of first shear screws 51 and third shear screws 75 to be sheared and annular hollow locking ring member 18 be displaced downhole from the first initial position as shown in FIG. 6 to the second operative position as best seen in FIG. 7.

In a preferred embodiment, coaxial piston member 74 is affixed to a push ring member 81 at a downhole end thereof via set screws 82 or the like. When force is applied to co-axial piston member 74, not only do first shear screws 51 and third shear screws 75 then become sheared, co-axial piston member 74 further causes push ring member 81 affixed to coaxial piston member 74 to move annular hollow locking ring member 18 downhole and from said initial first position to said second operative position.

As best shown in FIGS. 4-9, tool 20 of the present invention further possesses an inner mandrel 90 which serves to coaxially and slidably locate therein a cylindrical push rod member 91 capable of longitudinal sliding movement within a bore of inner mandrel 90. Inner mandrel 90 is coaxially located in a bore of outer cylindrical member 72, and fixedly coupled to outer cylindrical member 72 by way of set screws 92. Push rod member 91 is fixedly secured to coaxial piston member 74 by set screws 95. Forceable movement downhole of actuation rod 85 of setting tool 30 causes after having contacted push rod 91, causes movement downhole of coaxial piston member 74 and attached push ring member 81.

As best seen in FIGS. 4, 4A, 4B, and 6-10, locking screws 96, situated in a slotted track 97 on outer cylindrical member 72, allow longitudinal sliding movement downhole of coaxial piston member 74 relative to outer cylindrical member 72, after shearing of shear screws 75 which initially couple coaxial piston member 74 to outer cylindrical member 72.

Detailed Description of Locating and Locking Collet Baffle for Fracking Wireline With reference to FIGS. 3-10 and particularly FIGS. 5-10 and FIGS. 15A-K, a detailed description follows as to the manner of locating and positioning collet baffle 10 proximate a most distal end of a wellbore and proximate a most distal casing sub 102*c*, and thereafter locking same in such position within casing string 103 in order to thereafter being able to remove setting tool 30 and adapter tool 20 from casing string 103 and carry out a fracking operation at such location along casing string 103.

Figures 15A, 15B, 15C, 15D, 15E:
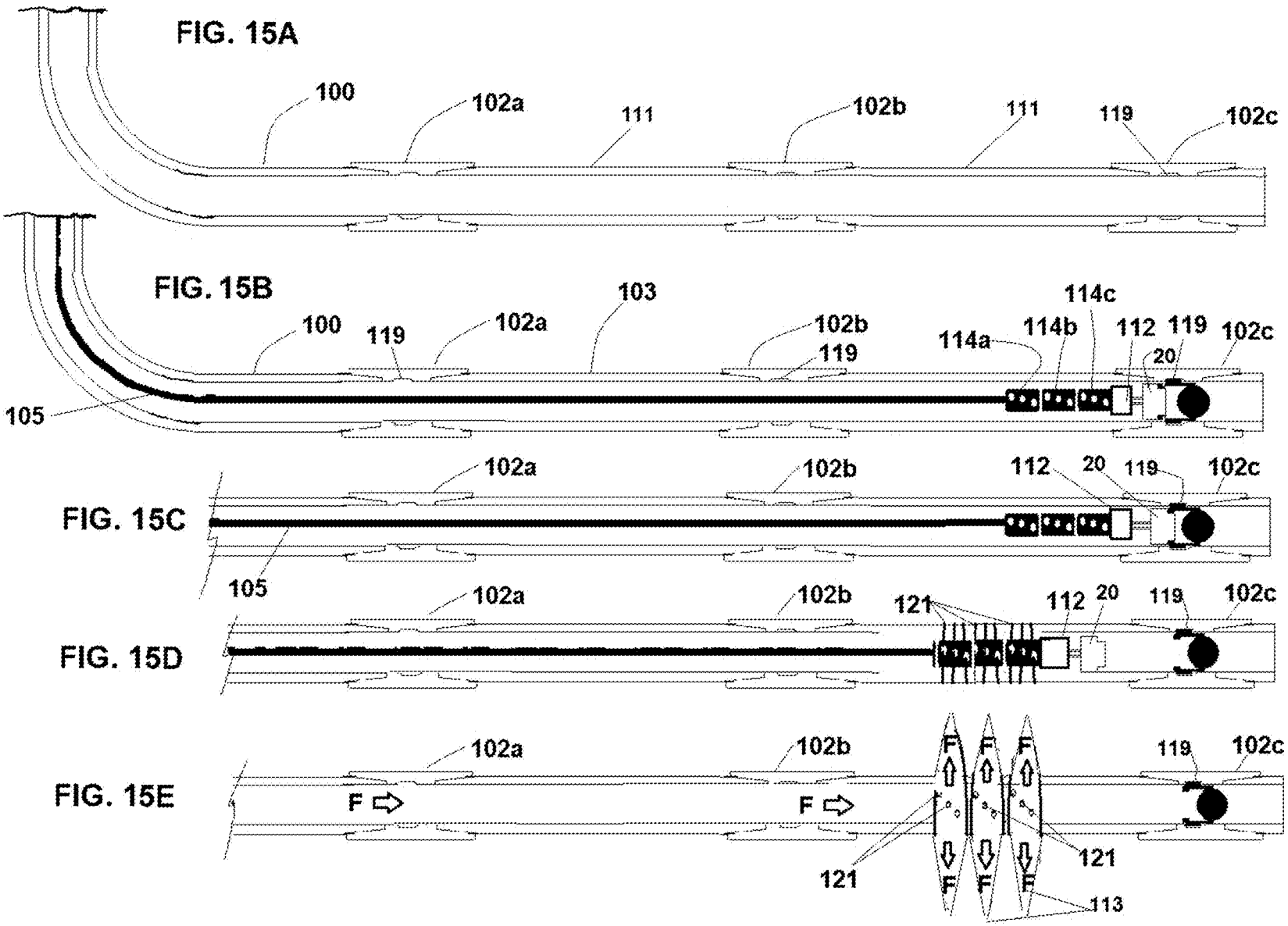
Figures 15F, 15G, 15H, 15J:
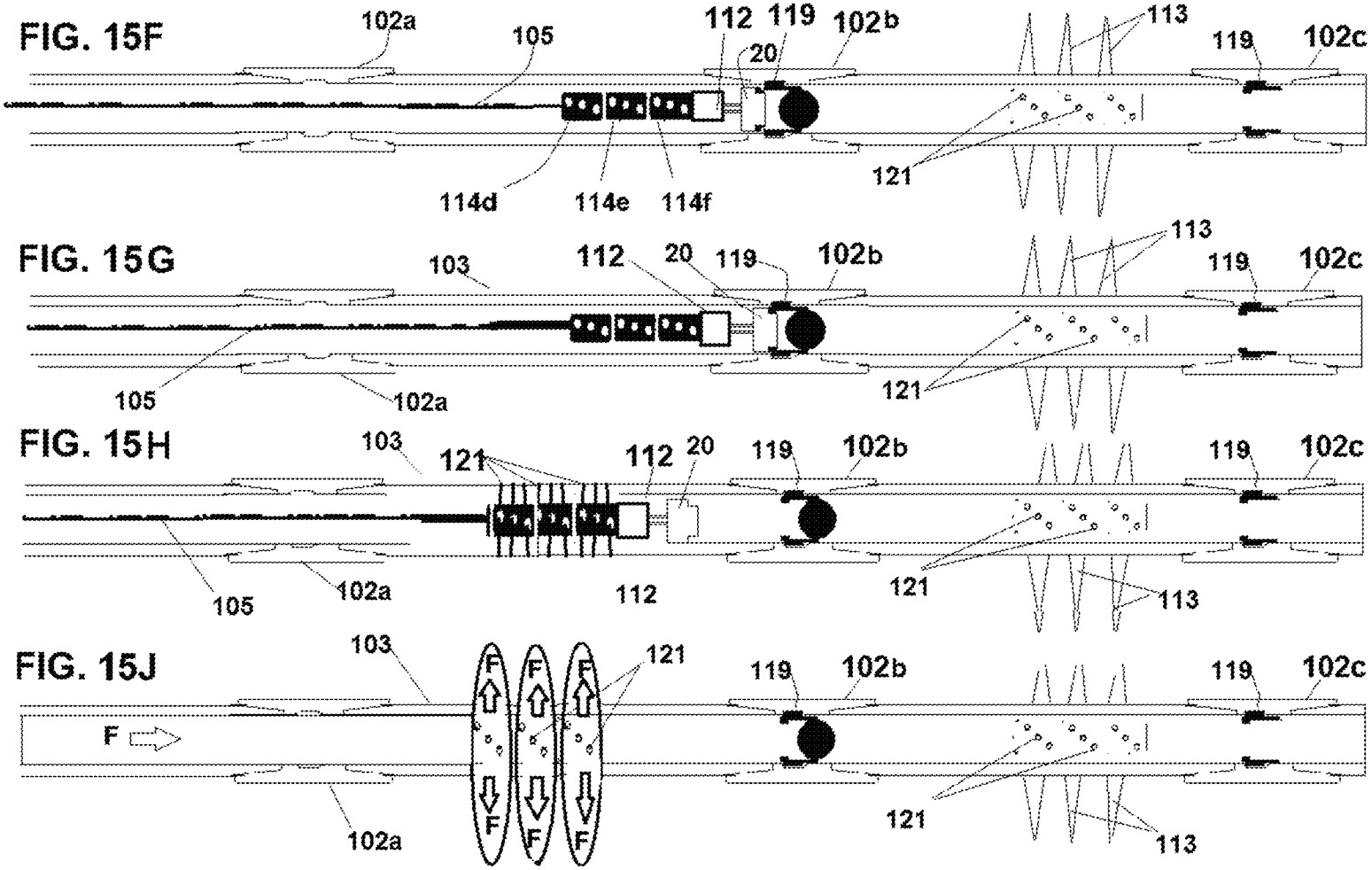

Firstly, as may be seen from FIGS. 3, 4, 4A, 4B, and 5-8, an adapter tool 20 as above-described is coupled via first shear screws 73 to an uphole end 26 of collet baffle 10. The collet baffle 10 may have a dart in the form of a spherical ball 40 initially located in ball seat 43 of collet baffle 10, or such ball 40 may be later flowed downhole immediately prior to commencing injection of fracking fluid "F" in the casing string 103 (ref. FIG. 15E).

Adapter tool 20 is then coupled, via a slotted tubular elongate adapter rod 77 having threads 64 on mutually opposite ends thereof, to mandrel 90 of tool 20 by insertion of a threaded end 64 of adapter rod 77 into mandrel 90. An opposite end of adapter rod 77 is threadably coupled to a downhole end of a wireline setting tool 30, such as a Baker Hughes #20 setting tool, or alternatively a Baker Hughes Model E-4 wireline pressure setting assembly ("WLPSA"), such being a gas-generating tool for the development of hydraulic force required to set wireline-deployed tools. Gas pressure is obtained by the electrical ignition of an igniter that activates the secondary igniter and an explosive charge. Wireline setting tool 30 at a downhole end has a gas-pressure actuated actuation rod 85, which is adapted when actuated to be forcefully extended downhole to contact push rod member 91 which is itself secured to coaxial piston member 74.

The resultant assembly is electrically and physically coupled to a wireline 105, and lowered into a formed casing string 103 (ref. FIG. 5 and FIG. 15B), to a region proximate the lowermost casing sub member 102 (ref. FIG. 6 and FIG. 15B). Annular ring 14 then engages circumferential groove proximate the casing sub 102 most proximate the distal end ("toe") of casing string 103.

As seen in FIG. 7 and FIG. 15C, setting tool 30 after being actuated via wireline 105, is caused to extend actuation rod 85 therefrom in a downhole direction and not only contact but thereafter forcefully displace push rod member 91 and thus also co-axial piston member 74 downhole, simultaneously shearing shear screws 75. Annular hollow locking ring 18 is thus moved downhole with push ring 81 contacting and moving downhole annular locking ring 18, while simultaneously shearing shear screws 51 previously retaining annular hollow locking ring 18 in its first initial position and moving it to its second operative position, where the portion 46 thereof having lesser diameter on annular locking ring member 18 is positioned so as to directly underlie annular ring 14, thereby locking annular ring 14 in circumferential groove 119 and thus lockingly retaining collet baffle 20 in casing string 103. By portion 48 of greater diameter contacting inwardly protruding portion 17 of annular ring 14, further downhole movement of annular hollow locking ring 18 is prevented.

Subsequent upward applied force on wireline 105, setting tool 30 and adapter tool 20 coupled thereto causes shear screws 73 to be sheared (ref. FIG. 8), thereby allowing wireline 10, setting tool 30 and adapter tool 20 to be moved slightly uphole (ref. FIG. 15D) to a position along the casing string that is desired to be fracked, and explosive charges 114*a*, 114*b*, and 114*c* on the wireline 105 detonated at such location so as to perforate casing string 105 and create perforations 112 (ref. FIG. 15E) at such location to thereafter allow injection of high pressure fluid into the formation to create fissures 1 in the rock of the formation.

Figure 10:
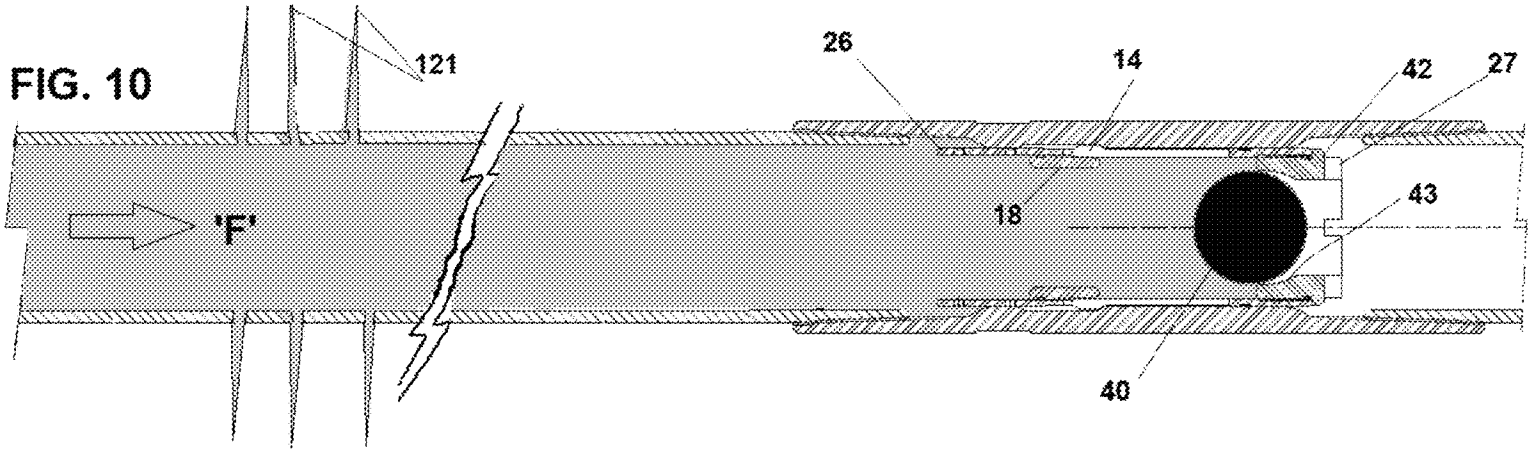
FIG. 10 is a view of the casing string used in the system of the present invention, in the region of the remaining collet baffle therein, after the wireline, attached setting tool, and attached downhole adapter tool have been moved out of the casing string.

Wireline 105, setting tool 30 and adapter tool 20 may be thereafter removed from the casing string and a pressurized fluid "F" injected into casing string 103 in order to frack the formation in the location of the created perforations 121 in the casing string 103, so as to create fissures 113 in the formation (ref. FIG. 10 and FIG. 15E.

Figure 11:
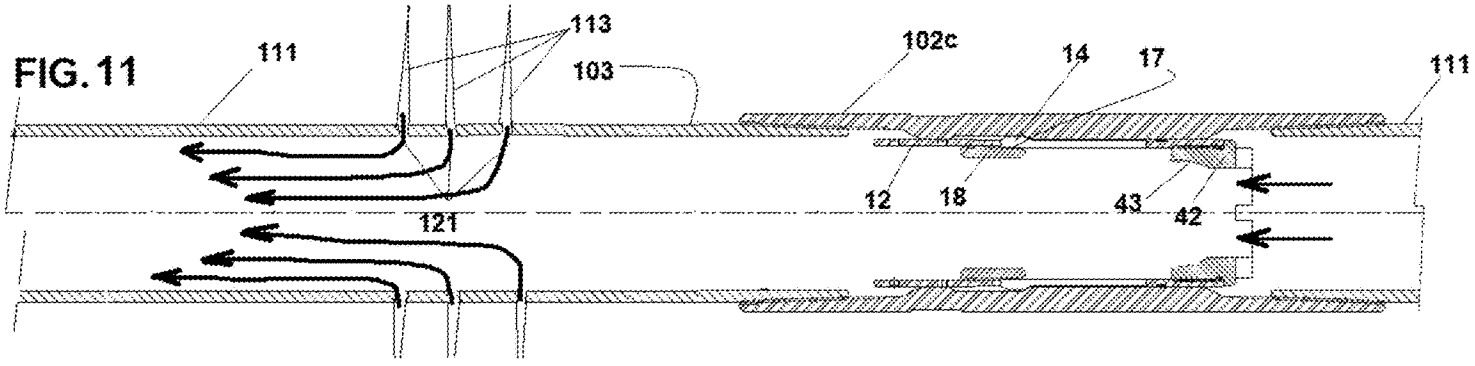
FIG. 11 is a view of the casing string and collet baffle used in the system of the present invention, after the dart member in the plug seat of the collet baffle has dissolved.

FIG. 11 in an enlarged view of the casing string 103 and casing sub member 102*c*, after the ball 40 seated in ball seat 43 has, due to exposure of such pressurized fluid "F" containing acid, been dissolved.

Figure 12:
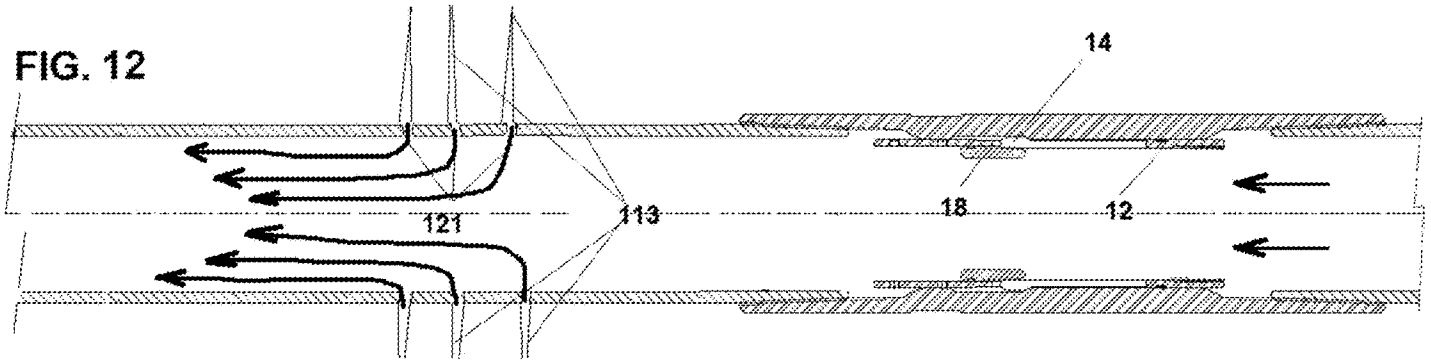
FIG. 12 is view of the casing string and collet baffle used in the system of the present invention, after the plug seat and plug member of the collet baffle has further dissolved.

FIG. 12 is a similar subsequent enlarged view of the casing string 103 and casing sub member 102*c*, after the ball seat 43 has further, due to exposure of such pressurized fluid "F" containing acid, been dissolved.

Figure 13:
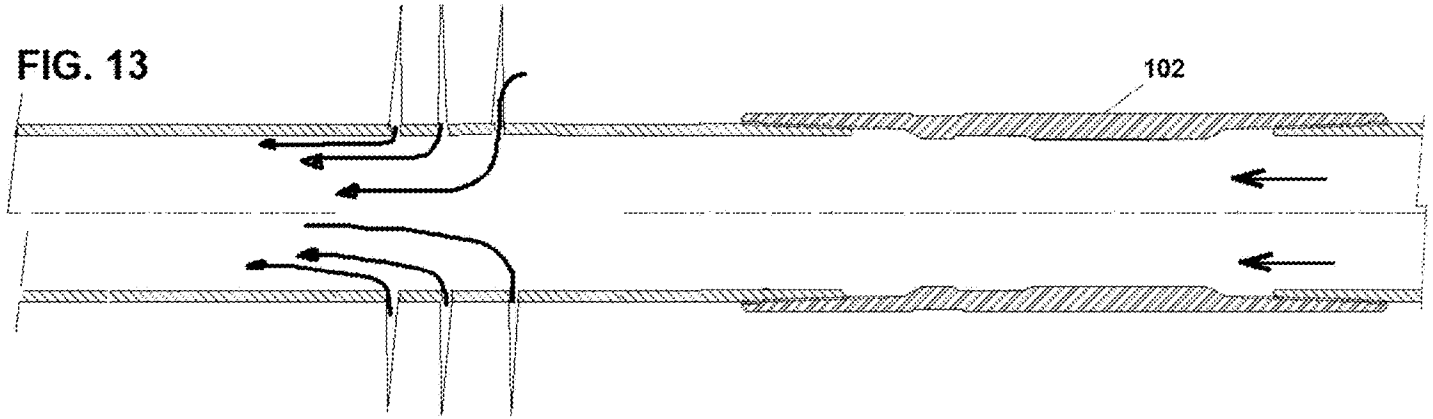
FIG. 13 is view of the casing string used in the system of the present invention, in an embodiment where the collet baffle and hollow annular locking ring therein are dissolvable, and such collet baffle and locking ring have dissolved.

FIG. 13 is a similar subsequent enlarged view of the casing string 103 and casing sub member 102*c*, after the annular hollow locking ring member 18 and hollow cylindrical member 12 of collet baffle 10 have been further, due to exposure of such pressurized fluid "F" containing acid, been dissolved, and production of fluid from the reservoir commenced via perforations 121 in casing string 103.

Detailed Description of Continued Locating of Collet Baffles and Fracking at Subsequent More Uphole Casing Sub Locations 102*b*, and Thereafter 102*a*

After completion of fracking of the formation proximate the distal end of casing string 103 proximate the most distal case sub member 102*c* as described above, and as may be seen in FIGS. 15F-J, an identical series of successive steps as described above areas conducted with regard to fracking the formation in the region of penultimate and more uphole casing sub member 102*b*.

Thereafter, again the above series of steps are further carried out with regard to more uphole casing sub 102*a* and at any other more successive uphole casing subs 102 in casing string 103, so that the casing string 103 is perforated and fracking carried out proximate all locations along casing string 103 in which the formation is desired to be fracked.

Figure 15K:
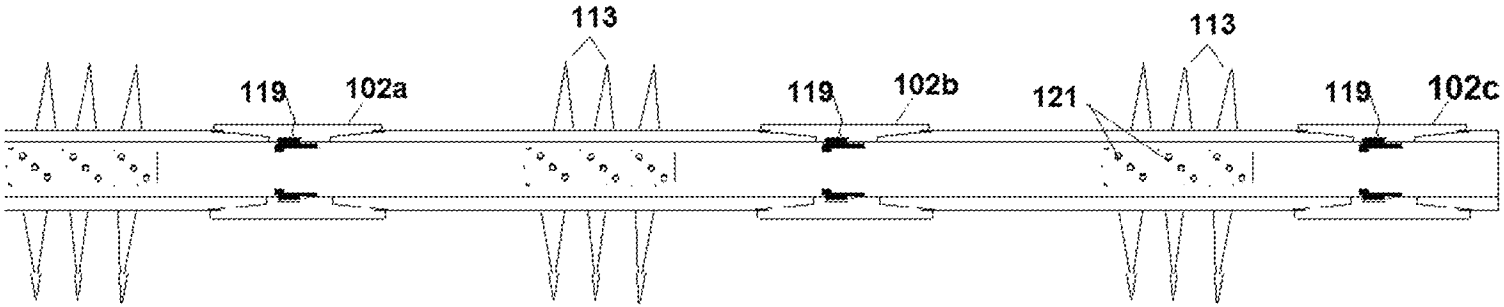

FIG. 15K shows the casing string 103 after perforation thereof at all desired locations therealong, and after fracking, and after dissolving of at least the ball 40 and plug seat 43 for each collet baffle 10 lockingly engaged with each casing sub member 102, in an embodiment where only these elements of collet baffle 10, and not the hollow cylindrical member 12 or the annular hollow locking ring member 18 thereof, are dissolvable.

Figure 15L:
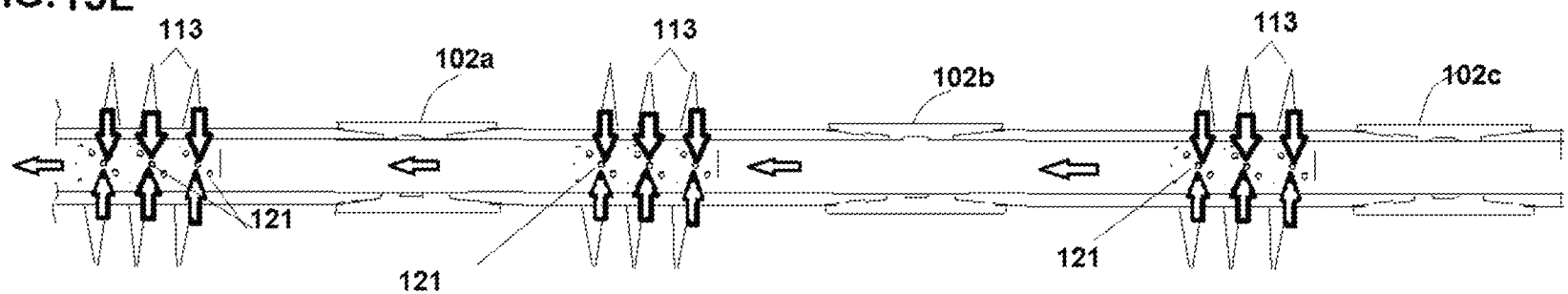

FIG. 15L shows a subsequent view of the casing string 103, when hydrocarbons from the formation have commenced flowing into the casing string 103 via perforations 121 therein, and are being pumped to surface.

Figure 14A:
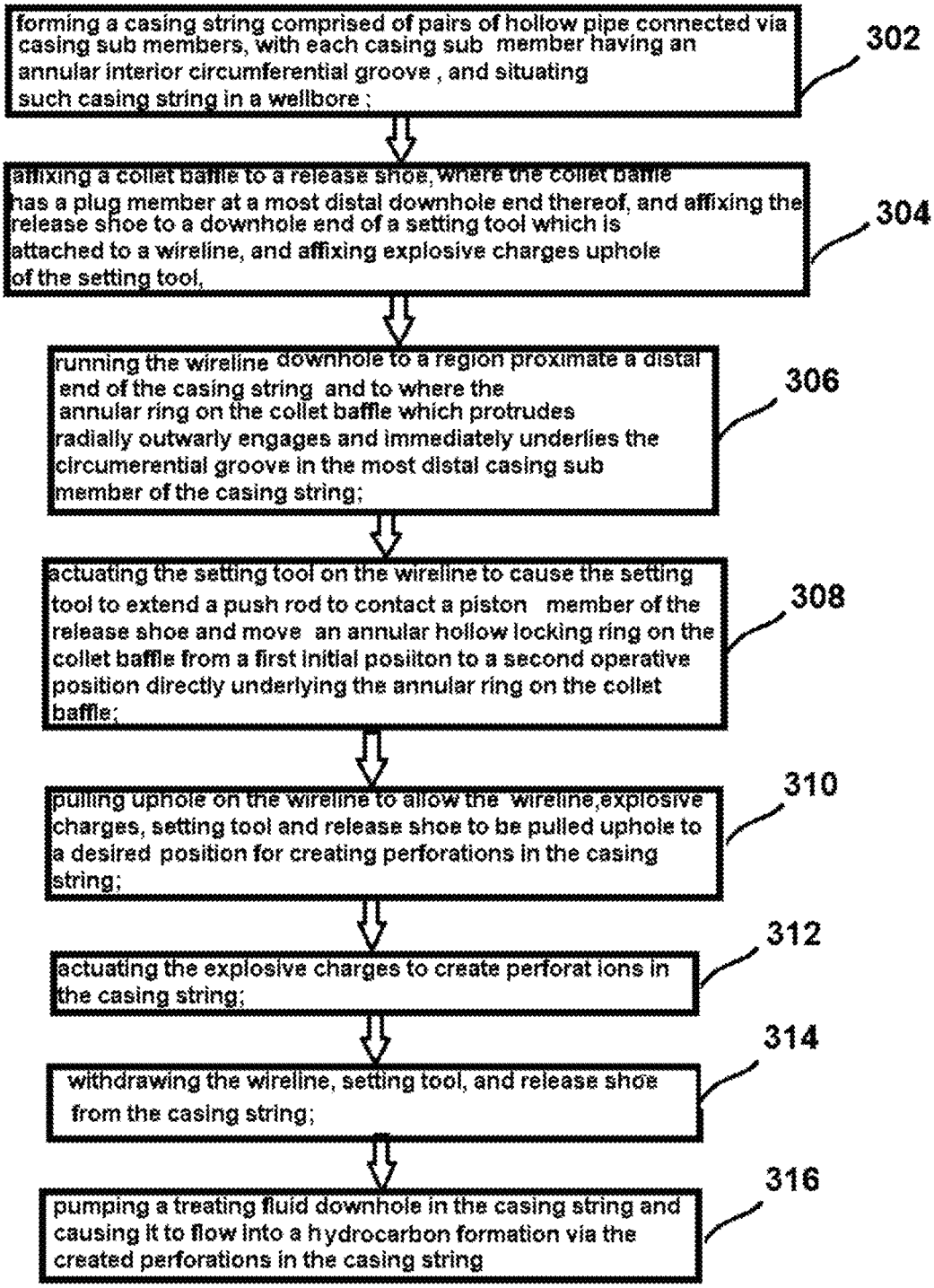
FIG. 14A is a flow diagram of one embodiment of the method of the present invention for perforating a casing string and further fracking a portion of a wellbore in the region of the created perforations.

FIG. 14A shows, in diagram form, a series of steps 302, 304, 306, 308, 310,312, 314, and 316, for one embodiment of the method of the present invention, which method includes and identically corresponds to the series of steps depicted in FIGS. 15A-15K and described above.

Such series of steps are in respect of the embodiment of the method where the collet baffle 10 initially includes a plug member in the form of a ball 40 seated in ball seat 43 or integral therewith when such collet baffle 10 is initially first attached to tool 20.

Figure 14B:
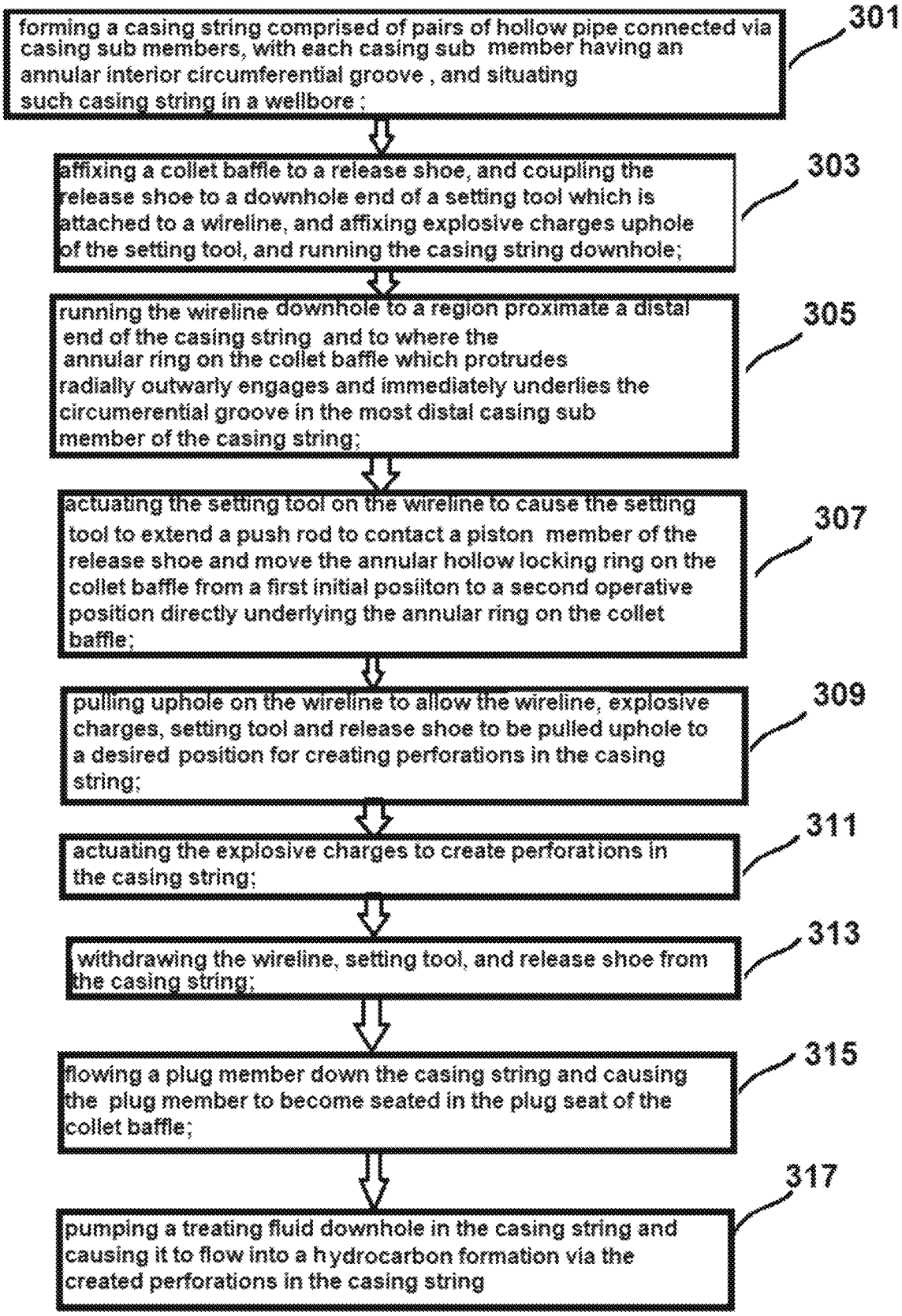
FIG. 14B is a flow diagram of a variation (another embodiment) of the method of the present invention for perforating a casing string and fracking a portion of a wellbore in the region of the created perforations.

FIG. 14B shows, in diagram form, a series of steps 301, 303, 305, 307, 309, 311, 313, 315, and 317 for an alternate method of the present invention.

Such alternate method does not employ a collet baffle 10 having a plug member which initially prea ball 40 initially situated in the ball seat 43 when the collet baffle 10 is affixed to the tool 20 at the end of setting tool 30 and wireline 105.

Rather such series of steps in such modified method differ from the method in FIG. 14A by utilizing a collet baffle which only has a ball seat 43 and which does not initially entirely obstruct flow of fluid through the collet baffle 10. Instead, in such modified method there is included step 315, namely the additional step prior to step 317, of:

after the actuation of setting tool 30 and consequent displacement of the annular lock ring 18 so as to lockingly secure annular ring 14 within circumferential groove 61 of the respective casing sub 102 (step 307);

after the perforation of the casing string at the desired location (step 311); and after each of the wireline 105, setting tool 30, and tool 20 are together withdrawn from the wellbore (step 313);

of flowing a dart member (such as a ball 40) downhole in casing string 103 and caused to become lodged in plug seat 43 of collet baffle 10 (step 315), so as to then entirely prevent flow of fluid through said collet baffle 10.

In such manner, the last step 317 in such method to then able to be conducted, namely the pumping of a treating or pressurized fluid downhole in casing string and causing it to flow into the hydrocarbon formation via created perforations in the casing string 103 immediately uphole of the respective collet baffle 20 and ball 40 now situated in the ball seat 43 thereof, thereby then fracking the wellbore at such location.

For a complete definition of the invention and its intended scope in its various embodiments, reference is to be made to the summary of the invention and the appended claims, read together with and considered with the disclosure and drawings herein.

We claim:

1. A collet baffle configured, so as to be capable of being conveyed downhole within a wellbore sub member in a wellbore via a wireline, comprising:

a hollow cylindrical member having a bore and an uphole and a downhole end;

a plurality of elongate, longitudinally-extending hollow slots situated in and circumferentially spaced about a cylindrical periphery of said hollow cylindrical member and situated proximate a mid-region thereof, each extending longitudinally along a portion of said cylindrical periphery of said hollow cylindrical member intermediate said uphole and downhole end of said hollow cylindrical member;

an annular ring of substantially uniform outer diameter about its outer circumference along an axial thereof, situated on a portion of an outer periphery of said hollow cylindrical member approximately intermediate said uphole and downhole end thereof, said angular ring protruding uniformly radially outwardly from said outer periphery of said hollow cylindrical member and extending axially along said outer periphery for a longitudinal distance and adapted for engaging a circumferential groove in an inner periphery of said wellbore sub-member said annular ring bisected at a plurality of locations thereon by said longitudinally-extending hollow slots, wherein said annular ring on said hollow cylindrical member is radially inwardly and outwardly resiliently flexible and when outwardly expanded is adapted to engage said circumferential groove;

a plug member, situated at said downhole end of said hollow cylindrical member and concentrically located within said hollow cylindrical member, which plug member alone or in subsequently in combination with a dart member subsequently flowed downhole which matingly engages said plug member, prevents passage of fluid through said hollow cylindrical member; and an annular hollow locking ring member situated in said bore of said hollow cylindrical member, releasably coupled via first shear means to an inner cylindrical periphery of said hollow cylindrical member in an initial first position uphole of said annular ring and not underlying said annular ring, said annular hollow locking ring member longitudinally slidable within said bore and adapted to be slidably moved, when said first shear means are sheared, from said first initial position uphole of said annular ring to a second operative position longitudinally downhole of said first initial position where at least a portion of said annular hollow locking ring member then underlies at least a portion of said annular ring so as then prevent any radial inward movement of said annular ring.

2. The collet baffle as claimed in claim 1;

wherein said annular ring further has a portion thereof protruding radially inwardly and more inwardly than an inner periphery of said hollow cylindrical member;

said annular hollow locking ring member further having over a portion of an outer periphery thereof a segment of a reduced diameter adjoining a segment of greater diameter, which segment of reduced diameter when said annular hollow locking ring member is slidably moved from said first initial position to said second operative position directly underlies said portion of said annular ring which extends radially inwardly; and when said annular hollow locking ring member is in said second operative position, said segment of greater diameter abuts said portion of said annular ring protruding radially inwardly and thereby prevents further slidable movement of said annular hollow locking ring member in a direction from said first initial position to said second operative position.

3. The collet baffle as claimed in claim 2, wherein said segment of reduced diameter on said annular hollow locking ring member is situated on a downhole side of said annular hollow locking ring member and said segment of greater diameter is located proximate an uphole end of said annular hollow locking ring member.

4. The collet baffle as claimed in claim 1, wherein annular hollow locking ring member is releasably coupled to said hollow cylindrical member in said first initial position by at least one shear pin or shear screw.

5. The collet baffle as claimed in claim 1, wherein said annular hollow locking ring member is dissolvable in a dissolving fluid.

6. The collet baffle as claimed in claim 1, wherein said dart member and said plug member are each dissolvable in a dissolving fluid.

7. The collet baffle as claimed in claim 1, wherein the hollow cylindrical member further possesses at least one shear screw situated in said periphery thereof proximate said uphole end thereof for releasably affixing said collet baffle to a wireline conveying tool.

8. The collet baffle as claimed in claim 1, wherein said dart member is a spherical ball, which may be flowed down the wellbore or alternatively may be initially inserted in a plug seat of the plug member of the collet baffle.

9. A tool for facilitating fracking operations within a hydrocarbon formation and for configured so as to be coupleable, at an uphole end thereof, to a wireline-conveyed setting tool, comprising:

a collet baffle as claimed in claim 1;

a substantially cylindrical release shoe, comprising:

i) an outer cylindrical member, a downhole portion of which is adapted to be coupled, via second shear means, to an inner periphery of said collet baffle proximate an uphole end thereof; and ii) a coaxial piston member situated in and slidably moveable within said outer cylindrical member and initially prevented from longitudinal sliding movement therein by being coupled thereto via third shear means;

wherein a distal end of said co-axial piston member, when a displacing force is applied to said co-axial piston member via a setting tool, contacts said annular hollow locking ring member of said collet baffle and shears said first shear means and causes said annular locking ring member to move downhole from said first initial position to said second operative position.

10. The tool for facilitating fracking operations as claimed in claim 9, said coaxial piston member having affixed to a downhole end thereof a push ring member, wherein said push ring member when said force is applied to said co-axial piston member, said co-axial piston member causes said push ring member to move said annular hollow locking ring member from said initial first position to said second operative position.

11. The tool for facilitating fracking operations as claimed in claim 9, wherein when a displacing force is applied to said co-axial piston member via said setting tool said third shear means are sheared to permit said coaxial piston member to slidably move downhole within said outer cylindrical member of said release shoe.

12. A wireline-conveyed system for perforating a wellbore and subsequently conducting fluid injection in a wellbore, comprising:

a collet baffle as claimed in claim 1;

a substantially cylindrical release shoe, comprising:

i) an outer cylindrical member, a downhole portion of which is adapted to be coupled, via second shear means, to an inner periphery of said collet baffle of claim 1 proximate an uphole end thereof; and ii) a coaxial piston member situated in and slidably moveable within said outer cylindrical member and initially prevented from longitudinal sliding movement therein by being coupled thereto via third shear means;

wherein a distal end of said co-axial piston member, when a displacing force is applied to said co-axial piston member via a setting tool, contacts said annular hollow locking ring member of said collet baffle and shears said third shear means and causes said annular locking ring member to move downhole from said first initial position to said second operative position;

a wireline;

a wireline-conveyed setting tool, coupled at a downhole end thereof to an uphole end of said substantially cylindrical release shoe; and one or more electrically-actuated explosive charges positioned along said wireline proximate said setting tool and immediately uphole of said setting tool.

13. A method for perforating and performing fluid treatment of a wellbore, such method comprising the steps of:

(i) forming a casing string comprised of a plurality of hollow pipes threadably connected to each other at casing subs, each of said casing subs threadably connecting pairs of pipes together and having an annular interior circumferential groove therein of a given width;

(ii) forming said casing string in a wellbore;

(iii) running a wireline down said casing string, said wireline having at a distal end thereof:

(a) a collet baffle as claimed in claim 1, wherein the plug member thereof itself is configured to substantially entirely prevent passage of fluid through said hollow cylindrical member thereof and no further dart member is needed to obstruct flow of fluid through the collet baffle;

(b) a substantially cylindrical release shoe, comprising:

i) an outer cylindrical member, a downhole portion of which is adapted to be coupled, via second shear means, to an inner periphery of said collet baffle of claim 1 proximate an uphole end thereof; and ii) a coaxial piston member situated in and slidably moveable within said outer cylindrical member and initially prevented from longitudinal sliding movement therein by being coupled thereto via third shear means; wherein a distal end of said co-axial piston member, when a displacing force is applied to said co-axial piston member via a setting tool, contacts said annular hollow locking ring member of said collet baffle and shears said third shear means and causes said annular locking ring member to move downhole from said first initial position to said second operative position;

(c) a setting tool, coupled at a downhole end thereof to an uphole end of said substantially cylindrical release shoe; and (d) one or more electrically-actuated explosive charges positioned along said wireline proximate said setting tool and immediately uphole of said setting tool;

(iv) running said wireline down said casing string to a location in said casing string proximate a distal end thereof, wherein said portion of said annular ring protruding radially outwardly from said outer periphery of said hollow cylindrical member directly overlies said annular interior circumferential groove in a most distal of said casing subs;

(v) actuating the setting tool to cause the setting tool to extend a push rod to contact the coaxial piston member, shear the second shear means, and force the co-axial piston member to contact the annular hollow locking ring member and thereafter shear the first shear means and force said annular hollow locking ring member to move from said first initial position to said second operative position where said annular ring operatively engages and is retained within said annular interior circumferential groove in the most distal of said casing subs s as to retain said collet baffle within said most distal casing sub;

(vi) pulling uphole on said wireline and causing said wireline, explosive charges, setting tool and release shoe to be pulled uphole to a desired position for creating perforations in said casing string;

(vii) actuating said explosive charges to create perforations in said casing string;

(viii) withdrawing said wireline, setting tool, and release shoe from said casing string; and (ix) pumping a treating fluid downhole in the casing string and causing it to flow into a hydrocarbon formation via said perforations in said casing string.

14. The method for perforating and performing fluid treatment of a wellbore as claimed in claim 13, further comprising the steps, after step (ix), of:

running a wireline down said casing string having the features of (a)-(d) of step (ii) above to a location wherein the annular ring of the collet baffle on the wireline directly underlies said circumferential interior annular groove in a penultimate of said casing subs in said casing string;

repeating steps (v) to (ix) in said method so as to perform a fluid treating step in the hydrocarbon formation at a second more uphole location along the casing string.

15. A method for perforating and performing fluid treatment of a wellbore, such method comprising the steps of:

(i) forming a casing string comprised of a plurality of hollow pipes threadably connected to each other at casing subs, each of said casing subs threadably connecting pairs of pipes together and having an annular interior circumferential groove therein of a given width;

(ii) forming said casing string in said wellbore;

(iii) running a wireline down said casing string, said wireline having at a distal end thereof:

(a) a collet baffle as claimed in claim 1, wherein said plug member thereof comprises a plug seat situated at said downhole end of said hollow cylindrical member and concentrically located within said hollow cylindrical member, and said plug seat along with a dart member when later flowed downhole as in step (ix) herein together prevent passage of fluid through said hollow cylindrical member; and (b) a substantially cylindrical release shoe, comprising:

i) an outer cylindrical member, a downhole portion of which is adapted to be coupled, via second shear means, to an inner periphery of said collet baffle of claim 1 proximate an uphole end thereof; and ii) a coaxial piston member situated in and slidably moveable within said outer cylindrical member and initially prevented from longitudinal sliding movement therein by being coupled thereto via third shear means;

wherein a distal end of said co-axial piston member, when a displacing force is applied to said co-axial piston member via a setting tool, contacts said annular hollow locking ring member of said collet baffle and shears said third shear means and causes said annular locking ring member to move downhole from said first initial position to said second operative position;

(c) a setting tool, coupled at a downhole end thereof to an uphole end of said substantially cylindrical release shoe; and (d) one or more electrically-actuated explosive charges positioned along said wireline proximate said setting tool and immediately uphole of said setting tool;

(iv) running said wireline down said casing string to a location in said casing string proximate a distal end thereof, wherein said portion of said annular ring protruding radially outwardly from said outer periphery of said hollow cylindrical member directly overlies said annular interior circumferential groove in a most distal of said casing subs;

(v) actuating said setting tool to cause said setting tool to extend a push rod to contact said a coaxial piston member of said release shoe, shear said second shear means, and force said co-axial piston member to contact said annular hollow locking ring member and thereafter shear said first shear means and force said annular hollow locking ring member to move from said first initial position to said second operative position where said annular ring operatively engages and is retained within said annular interior circumferential groove in a most distal of said casing subs so as to retain said collet baffle within said most distal casing sub;

(vi) pulling uphole on said wireline and causing said third shear means to shear and thereby allow the wireline, explosive charges, setting tool, and release shoe to be pulled uphole to a desired position for creating perforations in said casing string;

(vii) actuating said explosive charges to create perforations in said casing string;

(viii) withdrawing said wireline, setting tool, and release shoe from said casing string;

(ix) flowing said dart member down the casing string, and causing the dart member to become seated in the plug seat of the collet baffle; and (x) pumping a treating fluid downhole in the casing string and causing it to flow into a hydrocarbon formation via said perforations in said casing string.

16. The method for perforating and performing fluid treatment of a wellbore as claimed in claim 15, further comprising the steps, after step (x), of:

running a wireline down said casing string having the features of (a)-(d) of step (ii) above, to a location wherein the annular ring of the collet baffle on the wireline directly underlies said circumferential interior annular groove in a penultimate of said casing subs in said casing string;

repeating steps (v) to (x) in said method so as to perform a fluid treating step in the hydrocarbon formation at a second location along the casing string.

* * * * *